US006206508B1

(12) United States Patent
Asakawa et al.

(10) Patent No.: US 6,206,508 B1
(45) Date of Patent: Mar. 27, 2001

(54) LIQUID EJECTING METHOD, LIQUID EJECTING HEAD, AND HEAD CARTRIDGE USING SAME

(75) Inventors: Yoshie Asakawa, Nagano-ken; Hiroyuki Ishinaga, Tokyo; Makiko Kimura, Sagamihara; Toshio Kashino, Chigasaki; Takeshi Okazaki, Sagamihara; Aya Yoshihira, Yokohama; Kiyomitsu Kudo, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/706,462

(22) Filed: Sep. 4, 1996

(30) Foreign Application Priority Data

| | | |
|---|---|---|
| Sep. 4, 1995 | (JP) | 7-226878 |
| Sep. 20, 1995 | (JP) | 7-242013 |
| Jun. 7, 1996 | (JP) | 8-146248 |

(51) Int. Cl.[7] ..... B41J 2/05
(52) U.S. Cl. ..... 347/65
(58) Field of Search ..... 347/65, 63, 45

(56) References Cited

U.S. PATENT DOCUMENTS

| | | | |
|---|---|---|---|
| 4,480,259 | 10/1984 | Kruger et al. | 347/63 |
| 4,496,960 | 1/1985 | Fischbeck | 347/68 |
| 4,723,129 | 2/1988 | Endo et al. | 347/56 |
| 4,994,825 | 2/1991 | Saito et al. | 347/63 |
| 5,095,321 | 3/1992 | Saito et al. | 347/63 |
| 5,119,116 * | 6/1992 | Yu | 347/45 X |
| 5,175,565 | 12/1992 | Ishinaga et al. | 347/67 |
| 5,208,604 | 5/1993 | Watanabe et al. | 347/47 |
| 5,278,585 | 1/1994 | Karz et al. | 347/65 |
| 5,389,957 | 2/1995 | Kimura et al. | 347/20 |

FOREIGN PATENT DOCUMENTS

| | | | |
|---|---|---|---|
| 436047A1 | 7/1991 | (EP) | B41J/2/055 |
| 55-81172 | 6/1980 | (JP) | B41J/3/04 |
| 61-69467 | 4/1986 | (JP) | B41J/3/04 |
| 61-110557 | 5/1986 | (JP) | B41J/3/04 |
| 62-156969 | 7/1987 | (JP) | B41J/3/04 |
| 63-197652 | 8/1988 | (JP) | B41J/3/04 |
| 63-199972 | 8/1988 | (JP) | B41J/3/04 |
| 3-81155 | 4/1991 | (JP) | B41J/2/05 |
| 5-124189 | 5/1993 | (JP) | B41J/2/05 |
| 6-87214 | 3/1994 | (JP) | B41J/2/05 |

* cited by examiner

*Primary Examiner*—William J. Royer
(74) *Attorney, Agent, or Firm*—Fitzpatrick, Cella, Harper & Scinto

(57) ABSTRACT

A liquid ejecting method using a liquid ejection head having a movable member disposed faced to a bubble generating region and having a free end at a downstream side thereof with respect to a flow direction of liquid, wherein the free end of the movable member is displaced by a pressure generated by a bubble in the bubble generating region, and the pressure is directed toward an ejection outlet by the movable member to eject the liquid through the ejection outlet, the improvement residing in that: the free end of the movable member providing a substantially harmetically sealed state for the bubble generating region, is displaced so as to guide a pressure wave resulting from the bubble formation toward the ejection outlet while non-contact state is substantially maintained between the movable member and the bubble.

30 Claims, 33 Drawing Sheets

FIG. 14(a)
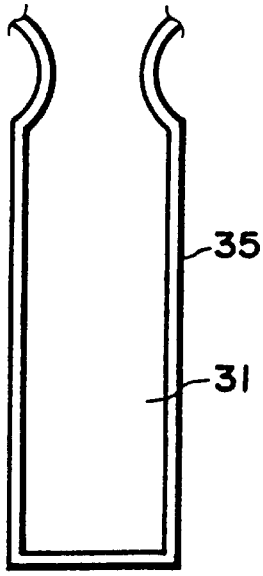
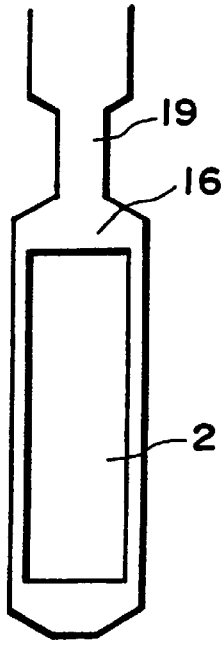
FIG. 14(c)
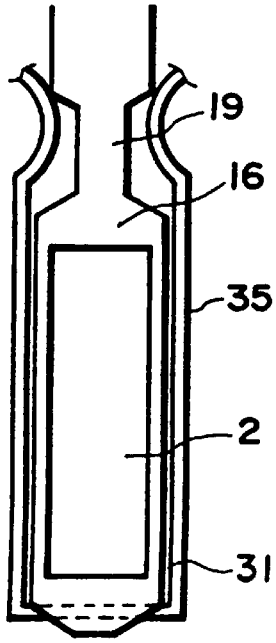
FIG. 14(b)
FIG. 15(a)
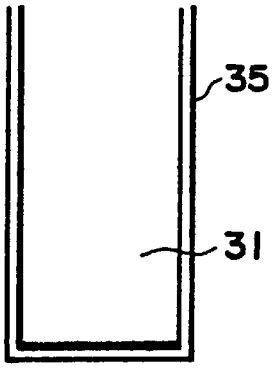
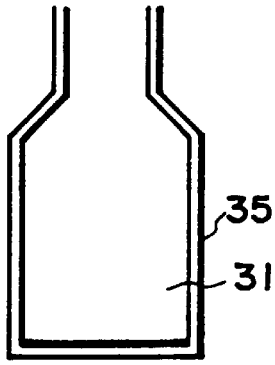
FIG. 15(c)
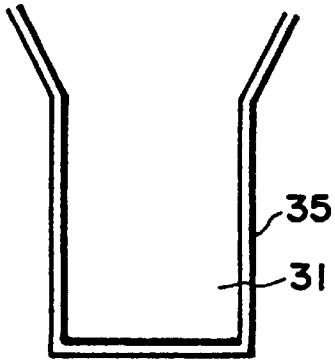
FIG. 15(b)

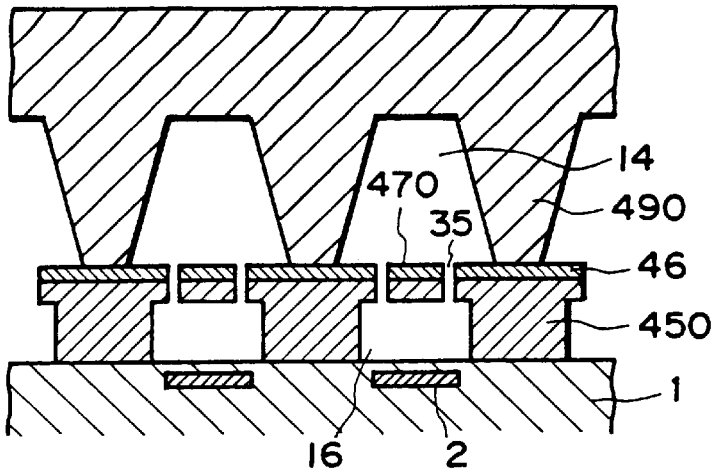
FIG. 31
FIG. 32(a)
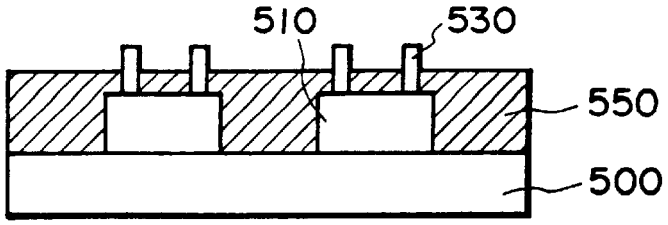
FIG. 32(b)
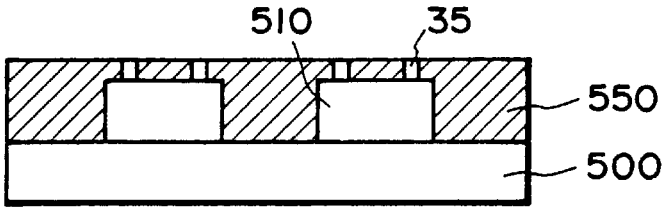
FIG. 32(c)
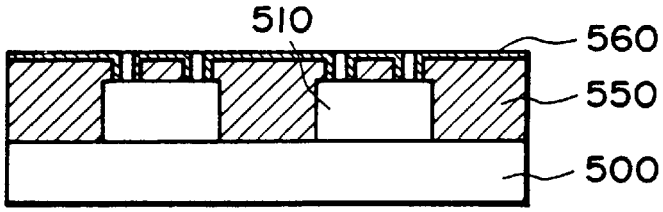
FIG. 32(d)
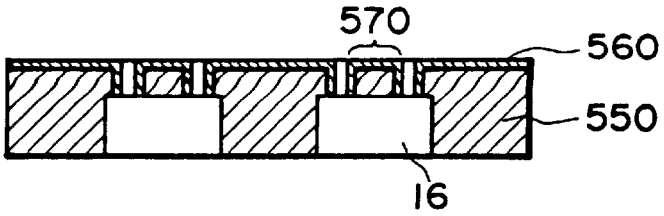

LIQUID EJECTING METHOD, LIQUID EJECTING HEAD, AND HEAD CARTRIDGE USING SAME

FIELD OF THE INVENTION AND RELATED ART

The present invention relates to a liquid ejecting head for ejecting desired liquid using generation of a bubble by applying thermal energy to the liquid, a head cartridge using the liquid ejecting head, a liquid ejecting device using the same, a manufacturing method for the liquid ejecting head, a liquid ejecting method, a recording method, and a print provided using the liquid ejecting method. It further relates to an ink jet head kit containing the liquid ejection head.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin materials glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 or the like discloses a flow passage structure as shown in FIG. 45, (*a*), (*b*). The invention of the flow passage structure and the head manufacturing method disclosed in the publication, is particularly directed to the backward liquid generated in accordance with generation of a bubble (the pressure propagated away from the ejection outlet namely toward the liquid chamber 12). The back wave is known as energy loss since it is not propagated toward the ejection direction.

FIG. 45, (*a*) and (*b*) disclose a valve 10 spaced from a generating region of the bubble generated by the heat generating element 2 in a direction away from the ejection outlet 11.

In FIG. 45, (*b*), this valve 10, is so manufactured from a plate that it has an initial position where it looks as if it stick on the ceiling of the flow path 3, and is deflected downward into the flow path 3 upon the generation of the bubble. Thus, the energy loss is suppressed by controlling a part of the backward wave by the valve 10.

However, with this structure, if the consideration is made as to the time when the bubble is generated in the flow path 3 having the liquid to be ejected, the suppression of a part of the backward wave by the valve 10 is not desirable.

The backward wave per se is not contributable to the ejection. At the time when the backward wave is generated inside the flow path 3, the pressure directly contributable to the ejection has already make the liquid ejectable from the flow path 3, as shown in FIG. 45, (*a*). Therefore, even if the backward wave is suppressed, the ejection is not significantly influenced, much less even if a part thereof is suppressed.

On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Even when it the liquid to be ejected is easily deteriorated by the heat, or is not sufficiently formed into a bubble, the liquid is desirably ejected without deterioration of the liquid.

From this standpoint. Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to quite a high degree. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Accordingly, it is a principal object of the present invention to provide a liquid ejection method wherein a generated bubble is controlled.

It is another object of the present invention to provide a liquid ejecting method, liquid ejecting head or the like, wherein a generated bubble pressure is propagated as ejection pressure without less to direct the ejection pressure toward the ejection outlet with high efficiency, thus permitting high speed liquid ejection.

It is a further object of the present invention to provide a liquid ejecting method, a liquid ejecting head or the like capable of increasing a printing speed by increasing the refilling frequency by reducing a meniscus retraction, using a valve function of a movable member, while suppressing inertia in the opposite direction from the liquid supply direction due to the backward wave.

It is a further object of the present invention to provide a liquid ejecting method, liquid ejecting head or the like wherein mixing of the ejection liquid and the bubble generation liquid is prevented, so that the deposited material on the heat generating element is reduced, and the range of usable liquid is widened with high ejection efficiency and ejection power.

It is a further object of the present invention to provide a manufacturing method for a liquid ejecting head with which such a liquid ejecting head is easily manufactured.

It is a further object of the present invention to provide a print having good images using the ejecting method of the present invention.

Invention 1 provides a liquid ejecting method using a liquid ejection head having a movable member disposed faced to a bubble generating region and having a free end at a downstream side thereof with respect to a flow direction of liquid, wherein the free end of the movable member is displaced by a pressure generated by a bubble in said bubble generating region, and the pressure is directed toward the ejection outlet by the movable member to eject the liquid through the ejection outlet, the improvement residing in that:

the free end of said movable member providing a substantially hermetically sealed state for the bubble generating region, is displaced so as to guide a pressure wave resulting from the bubble formation toward the ejection outlet while non-contact state is substantially maintained between said movable member and said bubble.

Invention 2 provides a method according to Invention 1, wherein said movable member is first substantially contacted to the bubble which is expanding or being guided toward the ejection outlet, while said movable member is returning toward its home position.

Invention 3 provides a method according to Invention 1, wherein said movable member has different liquid repellencies at a side faced to said bubble generating region and at the other side.

Invention 4 provides a liquid ejecting method using a liquid ejection head having a first liquid flow path in fluid communication with an ejection outlet, and a second liquid flow path disposed adjacent the first liquid flow path and having a bubble generating region, and a movable member having a free end adjacent the ejection outlet and disposed between said first liquid flow path and a bubble generating region of said second liquid flow path, wherein a bubble is generated in said bubble generating region, and the free end of the movable member is displaced into said first liquid flow path by a pressure generated by the bubble to eject the liquid through the ejection outlet, the improvement residing in that:

the free end of said movable member providing a substantially hermetically sealed state for the bubble generating region, is displaced so as to guide a pressure wave resulting from the bubble formation toward the ejection outlet while non-contact state is substantially maintained between said movable member and said bubble.

Invention 5 provides a method according to Invention 4, wherein said movable member is first substantially contacted to the bubble which is expanding or being guided toward the ejection outlet, while said movable member is returning toward its home position.

Invention 6 provides a method according to Invention 4, wherein said movable member has different liquid repellencies at a side faced to said bubble generating region and at the other side.

Invention 7 provides a liquid ejecting method using a liquid ejection head having a movable member disposed faced to a bubble generating region and having a free end at a downstream side thereof with respect to a flow direction of liquid, wherein the free end of the movable member is displaced by a pressure generated by a bubble in said bubble generating region, and the pressure is directed toward the ejection outlet by the movable member to eject the liquid through the ejection outlet, the improvement residing in that:

said movable member is first substantially contacted to the bubble which is expanding or being guided toward the ejection outlet, while said movable member is returning toward its home position.

Invention 8 provides a liquid ejecting method using a liquid ejection head having a first liquid flow path in fluid communication with an ejection outlet, and a second liquid flow path disposed adjacent the first liquid flow path and having a bubble generating region, and a movable member having a free end adjacent the ejection outlet and disposed between said first liquid flow path and a bubble generating region of said second liquid flow path, wherein a bubble is generated in said bubble generating region, and the free end of the movable member is displaced into said first liquid flow path by a pressure generated by the bubble to eject the liquid through the ejection outlet, the improvement residing in that:

said movable member is first substantially contacted to the bubble which is expanding or being guided toward the ejection outlet, while said movable member is returning toward its home position.

Invention 9 provides a method according to Invention 7, wherein said movable member has different liquid repellencies at a side faced to said bubble generating region and at the other side.

Invention 10 provides a method according to Invention 1, wherein said bubble is generated by film boiling phenomenon caused by applying heat generated by a heating element to the liquid.

Invention 11 provides a method according to Invention 1, wherein the bubble generated in said bubble generating region expands into first liquid flow path in accordance with displacement of liquid ejecting method.

Invention 12 provides a method according to Invention 1, wherein said second flow path contains liquid which is different from the liquid in said first liquid flow path and which is higher at least in the lowness of the viscosity, in the bubble generation property and in stabilization against heat.

Invention 13 provides a liquid ejecting head for ejection liquid by generation of a bubble, comprising:

a first liquid flow path in fluid communication with an ejection outlet for ejecting the liquid;

a second liquid flow path having a heat generating element for generating a bubble in the liquid by applying heat to the liquid; and a separation wall disposed between said first liquid flow path and said second liquid flow path, wherein said separation wall has a movable member, having a free end at a side closer to the ejection outlet, said free end being displaced to said first liquid flow path on the basis of a pressure generated by a bubble generated in said second flow path to transmit the pressure to the first flow path, and wherein said free end has different liquid repellencies at its side faced to said first liquid low path and at its side faced to said second liquid low path.

Invention 14 provides an ejection head according to Invention 13, wherein the liquid-repellency is higher at the side faced to said first liquid flow path than at the other side.

Invention 15 provides an ejection head according to Invention 13, wherein the side faced to said first liquid flow path has a water repelling material layer.

Invention 16 provides an ejection head according to Invention 13, wherein said separation wall comprises two members having different liquid-repellencies.

Invention 17 provides an ejection head according to Invention 16, wherein said separation wall has a layer of a material having a liquid-repellency higher than that of the separation wall, at the side faced to said first liquid flow path.

Invention 18 provides an ejection head according to Invention 16, wherein said separation wall has a layer of a material having a liquid-repellency lower than that of the separation wall, at the side faced to said second liquid flow path.

Invention 19 provides an ejection head according to Invention 13, wherein said separation wall has a roughened surface at the side faced to second liquid flow path.

Invention 20 provides an ejection head according to Invention 14, wherein said bubble is generated by film boiling phenomenon caused by applying heat generated by a heating element disposed in said second liquid path to the liquid.

Invention 21 provides an ejection head according to Invention 20, wherein said heat generating element is in the form of an electrothermal transducer for generating heat upon receipt of electric signal.

Invention 22 provides an ejection head according to Invention 13, wherein said movable member is of metal such as nickel, gold.

Invention 23 provides an ejection head according to Invention 13, wherein said second flow path having the heat generating element is in the form of a chamber.

Invention 24 provides a head cartridge comprising a liquid ejecting head as defined in Invention 13 and a liquid container for containing the liquid to be supplied to the liquid ejecting head.

Invention 25 provides a head cartridge according to Invention 24, wherein said ejection head and said liquid container are separable from each other.

Invention 26 provides a head cartridge according to Invention 25, wherein the liquid has been refilled into said container.

Invention 27 provides a liquid ejection apparatus comprising a liquid ejecting head and driving signal supply means for supplying a driving signal for ejecting the liquid from the liquid ejecting head.

Invention 28 provides a liquid ejection apparatus comprising a liquid ejecting head as defined in Invention 13, and recording material feeding means for feeding a recording material for receiving the liquid ejected from said liquid ejecting head.

Invention 29 provides a liquid ejection apparatus according to Invention 27, wherein the liquid which is ink is ejected onto a recording material which is a recording paper, textile, leather, plastic resin material, metal or wood.

Invention 30 provides a print produced through said liquid ejecting method as defined in Invention 1.

Invention 31 provides manufacturing method for a liquid ejection head which includes a first liquid flow path in fluid communication with an ejection outlet for ejecting the liquid; a second liquid flow path having a heat generating element for generating a bubble in the liquid by applying heat to the liquid; and a separation wall disposed between said first liquid flow path and said second liquid flow path, wherein said separation wall has a movable member, having a free end at a side closer to the ejection outlet, said free end being displaced to said first liquid flow path on the basis of a pressure generated by a bubble generated in said second flow path to transmit the pressure to the first flow path, and wherein said free end has different liquid repellencies at its side faced to said first liquid flow path and at its side faced to said second liquid flow path, the improvement comprising a step of:

providing different liquid-repellencies for a first liquid flow path side and a second liquid flow path side of the separation wall.

Invention 32 provides a method according to Invention 31, wherein the liquid-repellency is higher at the side faced to said first liquid flow path than at the other side.

Invention 33 provides a method according to Invention 31, wherein a water repelling material is applied on the first liquid flow path side surface of said separation wall.

Invention 34 provides a method according to Invention 33, wherein said water repelling material application is effected in a process of forming the separation wall.

Invention 35 provides a method according to Invention 31, wherein said separation wall is formed by two different materials to provide the different liquid-repellencies.

Invention 36 provides a method according to Invention 35, wherein said two materials are a base material and a layer having a liquid-repellency higher than that of the base material.

Invention 37 provides a method according to Invention 35, wherein said two materials are a base material and a layer having a liquid-repellency higher than that of the base material.

Invention 38 provides a method according to Invention 36, wherein said two materials are a base material and a plated layer having a liquid-repellency different from that of the base material.

Invention 39 provides a method according to Invention 31, wherein a first liquid flow path side surface of said separation wall is roughened.

According to an aspect of the present invention, the bubble generation and the returning displacement of the movable member can be used with synergistic effect, so that the liquid adjacent the ejection outlet can be ejected at high-speed speed with high directivity, and therefore, the refilling frequency can be made higher than in a conventional bubble jet type ejecting method, head or the like, and the shot accuracy on the recording material is improved, thus improving the image quality.

According to another aspect of the present invention, the pressure wave produced by the bubble generation is directed toward the ejection outlet, so that the following growth of the bubble is permitted with high efficiency and certainty toward the ejection outlet side.

According to a further aspect of the present invention, the growth of the bubble is further assured toward the ejection outlet.

According to a further aspect of the present invention, the ejected ink is prevented from flowing toward the bubble generation liquid chamber, and the refilling of the bubble generation liquid is made easier to accomplish stabilized recording.

In another aspect of the present invention, even if the printing operation is started after the recording head is left in a low temperature or low humidity condition for a long term, the ejection failure can be avoided. Even if the ejection failure occurs, the normal operation is recovered by a small scale recovery process including a preliminary ejection and sucking recovery.

In an aspect of improving the refilling property, the responsivity, the stabilized growth of the bubble and stabilization of the liquid droplet during the continuous ejections are accomplished, thus permitting high speed recording.

These and other objects, features and advantages of the present invention will become more apparent upon a consideration of the following description of the preferred embodiments of the present invention taken in conjunction with the accompanying drawings.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

Additionally, in this specification "substantial contact between the bubble and the movable member" means a situation under which the bubble and the movable member are physically contacted with each other at least at a part or a situation under which a thin liquid film exists therebetween, and the growth of the bubble and the movement of the movable member are influenced with each other.

BRIEF DESCRIPTION OF THE DRAWINGS

FIG. 14, consisting of FIGS. 14(*a*) through 14(*c*), illustrates a structure of a movable member and liquid flow path.

FIG. 15, consisting of FIGS. 15(*a*) through 15(*c*), illustrates another configuration of a movable member.

FIG. 31 is a sectional view of an ink jet recording head in a step of FIG. 30, as seen from the ejection outlet side.

FIG. 32 is a schematic sectional view illustrating another manufacturing step for the separation wall. In (*a*), an integral member for the bubble generation liquid flow path and the separation wall are formed; In (*b*), only the resist for the movable member formation is removed; In (*c*), water repelling material has been applied; and in (*d*), the substrate and the nickel plate have been separated from each other.

DESCRIPTION OF THE PREFERRED EMBODIMENT

<Embodiment 1>

Figure 1A:
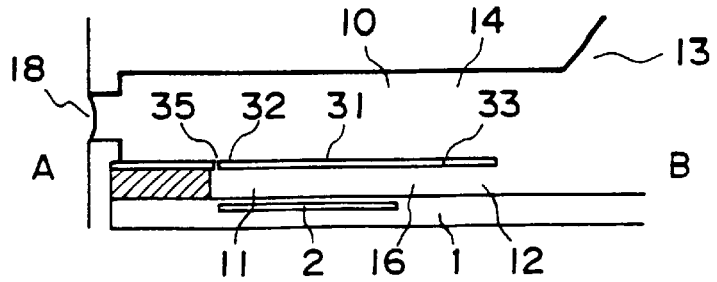
FIG. 1, consisting of FIGS. 1(*a*) through 1(*e*), is a schematic sectional view showing an example of a liquid ejecting head according to an embodiment of the present invention.

Referring to the accompanying drawings, the embodiments of the present invention will be described.

In this embodiment, the description will be made as to an improvement in an election force and/or an ejection efficiency by controlling a direction of propagation of pressure resulting from generation of a bubble for ejecting the liquid and controlling a direction of growth of the bubble. FIG. 1 is a schematic sectional view of a liquid ejecting head taken along a liquid flow path according to this embodiment, and FIG. 2 is a partly broken perspective view of the liquid ejecting head.

The liquid ejecting head of this embodiment comprises a heat generating element 2 (a heat generating resistor of 40 μm×105 μm in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. The movable member 31 is faced to the heat generating element 2 with a gap of 15 μm approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIG. 1, (*b*) and (*c*) or in FIG. 2. By the displacement of the movable member 31 or the state after the displacement, the propagation of the pressure caused by the generation of the bubble and the growth of the bubble per se are directed toward the ejection outlet.

Here, one of the fundamental ejection principles used by the present invention will be described. One of important principles of this invention is that the movable member disposed faced to the bubble is displaced from the normal first position to the displaced second position on the basis of the pressure produced by the generation of the bubble, and the displacing or displaced movable member 31 is effective to direct the pressure produced by the generation of the bubble and/or the growth of the bubble per se toward the ejection outlet 18 (downstream side).

Figure 3:
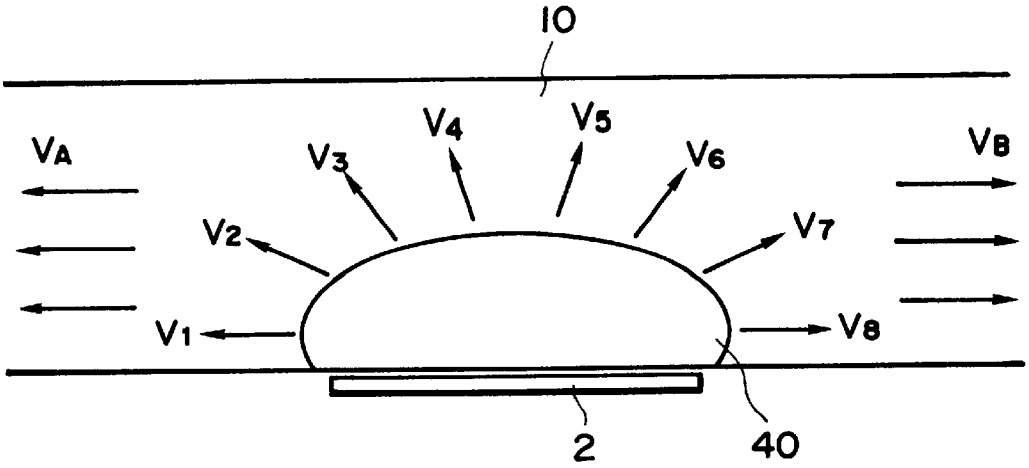
FIG. 3 is a schematic view showing pressure propagation from a bubble in a conventional head.
Figure 4:
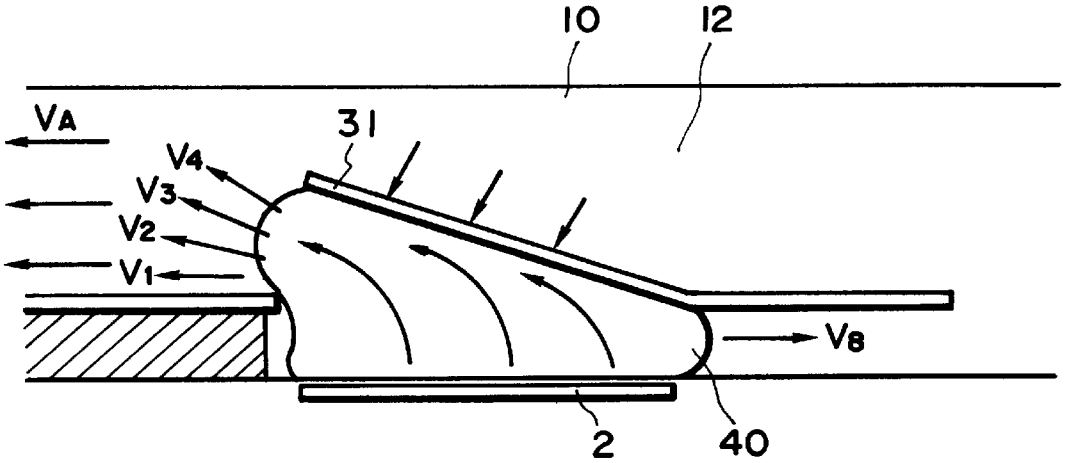
FIG. 4 is a schematic view showing pressure propagation from a bubble in a head according to an embodiment of the present invention.

More detailed description will be made with comparison between the conventional liquid flow passage structure not using the movable member (FIG. 3) and the present invention (FIG. 4). Here, the direction of propagation of the pressure toward the ejection outlet is indicated by $V_A$, and the direction of propagation of the pressure toward the upstream is indicated by $V_B$.

In a conventional head as shown in FIG. 3, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. This portion is important since it directly contributable to the liquid election efficiency the liquid election pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 4, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 1, the ejecting operation of the liquid ejecting head in this embodiment will be described in detail.

FIG. 1, (*a*) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 1, (*b*) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 1, (*c*) shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

In FIG. 1, (*d*), the movable member 31 is substantially contacted to the bubble 40 in the process of returning from the second position (maximum displacement position) as a result of the growth of the bubble 40. The generated bubble 40 grows more toward the downstream than toward the upstream, and continues to grow greatly beyond the first position (broken line position) of the movable member. With the growth of the bubble 40, the movable member 31 makes returning displacement by which the pressure propagation and the volume displacement of the bubble 40 are uniformly directed toward the ejection outlet, and therefore, the ejection efficiency can be increased. Thus, the movable member is positively contributable to direct the bubble and the resultant pressure toward the ejection outlet so that the propagation direction of the pressure and the growth direction of the bubble can be controlled efficiently.

FIG. 1, (*e*) shows the bubble 40 contracting and extinguishing by the decrease of the internal pressure of the bubble after the film boiling.

The movable member 31 returns to the initial position shown in FIG. 1, (*a*) by the negative pressure due to the contraction of the bubble and by the restoring force due to the resiliency of the movable member per se. When the bubble is extinguishing, the liquid flows from the upstream (B) namely from the common liquid chamber side as indicated by VD1 and VD2 and from the ejection outlet side as indicated by Vc so as to compensate for the volume of the collapsed bubble in the bubble generating region 11 and the volume of the liquid ejected.

In the foregoing, the description has been made as to the operation of the movable member 31 with the generation of the bubble and the ejecting operation of the liquid. Now, the description will be made as to the refilling of the liquid in the liquid ejecting head of the present invention.

Referring to FIG. 1, liquid supply mechanism will be described.

When the bubble 40 enters the bubble collapsing process after the maximum volume thereof (Figure, (d)), a volume of the liquid enough to compensate for the collapsing bubbling volume flows into the bubble generation region from the ejection outlet 18 side of the first liquid flow path 14 and from the common liquid chamber side 13 of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 1. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 5:
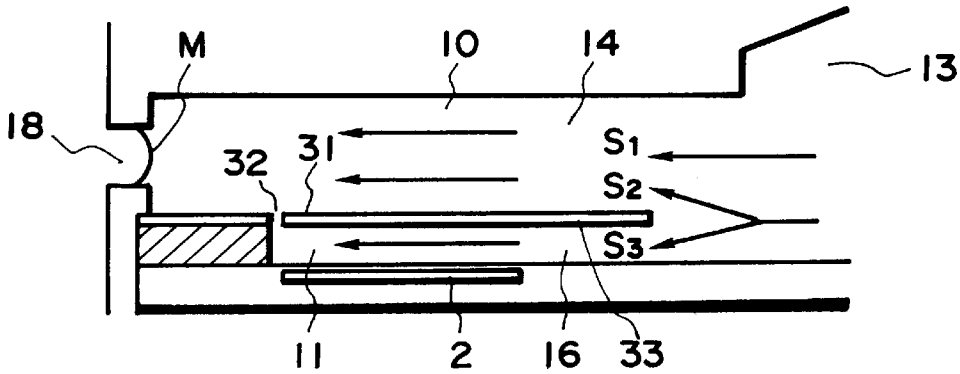
FIG. 5 is a schematic view illustrating flow of liquid in an embodiment of the present invention.

The positional relation between the free end 32 and the fulcrum 33 of the movable member 31 is such that the free end is at a downstream position of the fulcrum as shown in FIG. 5, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted by the ejection as shown in FIG. 5, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded. More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the election of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

<Embodiment 2>

Figure 6:
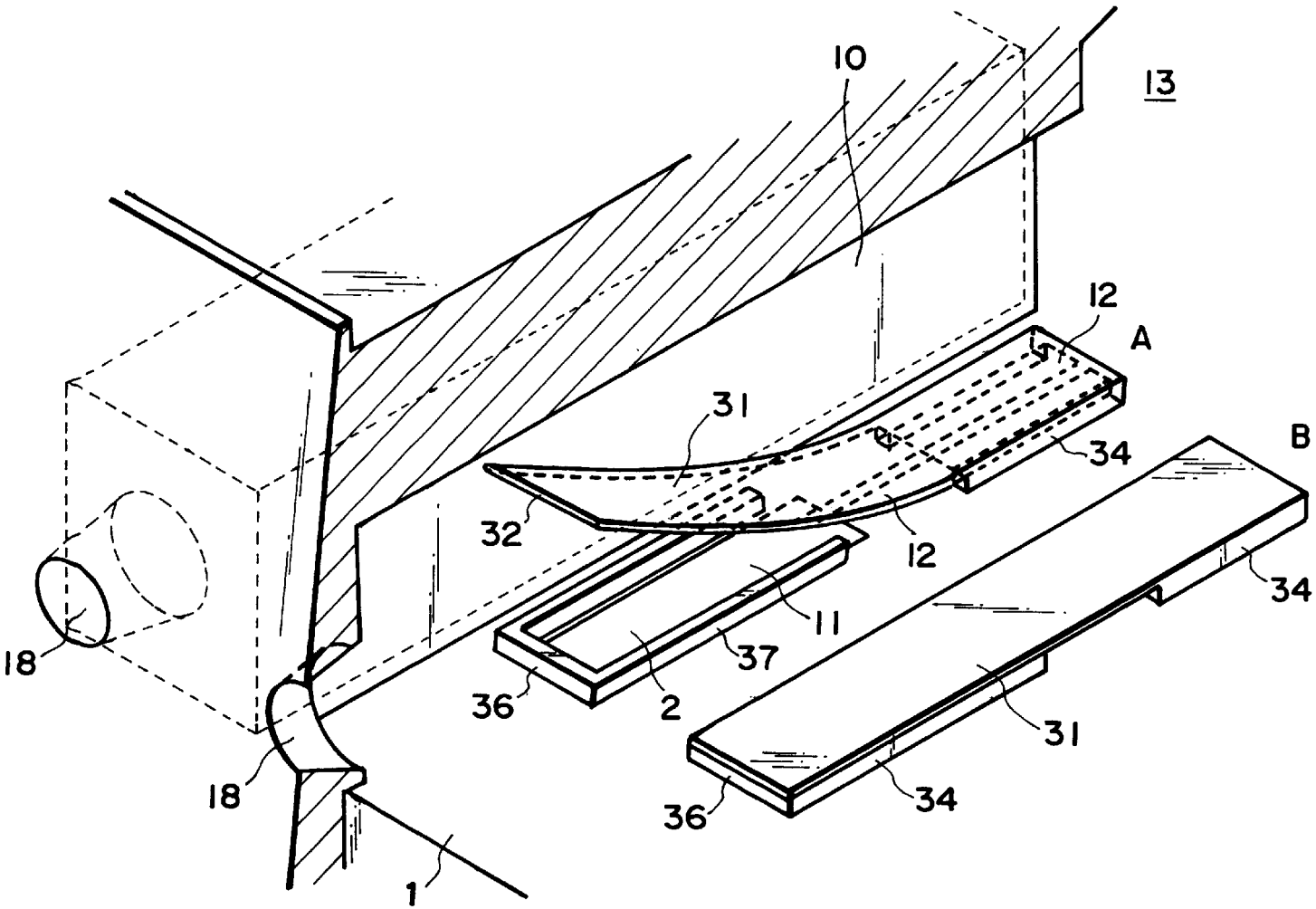
FIG. 6 is a partly broken perspective view of a liquid ejecting head according to a second embodiment of the present invention.

FIG. 6 shows a second embodiment. In FIG. 6, A shows a displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

A foundation 34 is provided at each side, and between them, a liquid supply passage 12 is constituted. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that the ejection outlet 18 side of the bubble generation region 11 is substantially sealed. Thus, the pressure produced by the bubble at the time of the bubble generation and particularly the pressure downstream of the bubble, can be concentrated on the free end side side of the movable member, without releasing the pressure.

In the process of the collapse of bubble, the movable member 31 returns to the first position, and the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

In this embodiment, the foundation 34 for supporting and fixing the movable member 31 is provided at an upstream position away from the heat generating element 2, as shown in FIG. 2 and FIG. 6, and the foundation 34 has a width smaller than the liquid flow path 10 to supply the liquid to the liquid supply passage 12. The configuration of the foundation 34 is not limited to this structure, but may be anyone if smooth refilling is accomplished.

<Embodiment 3>

Figure 7:
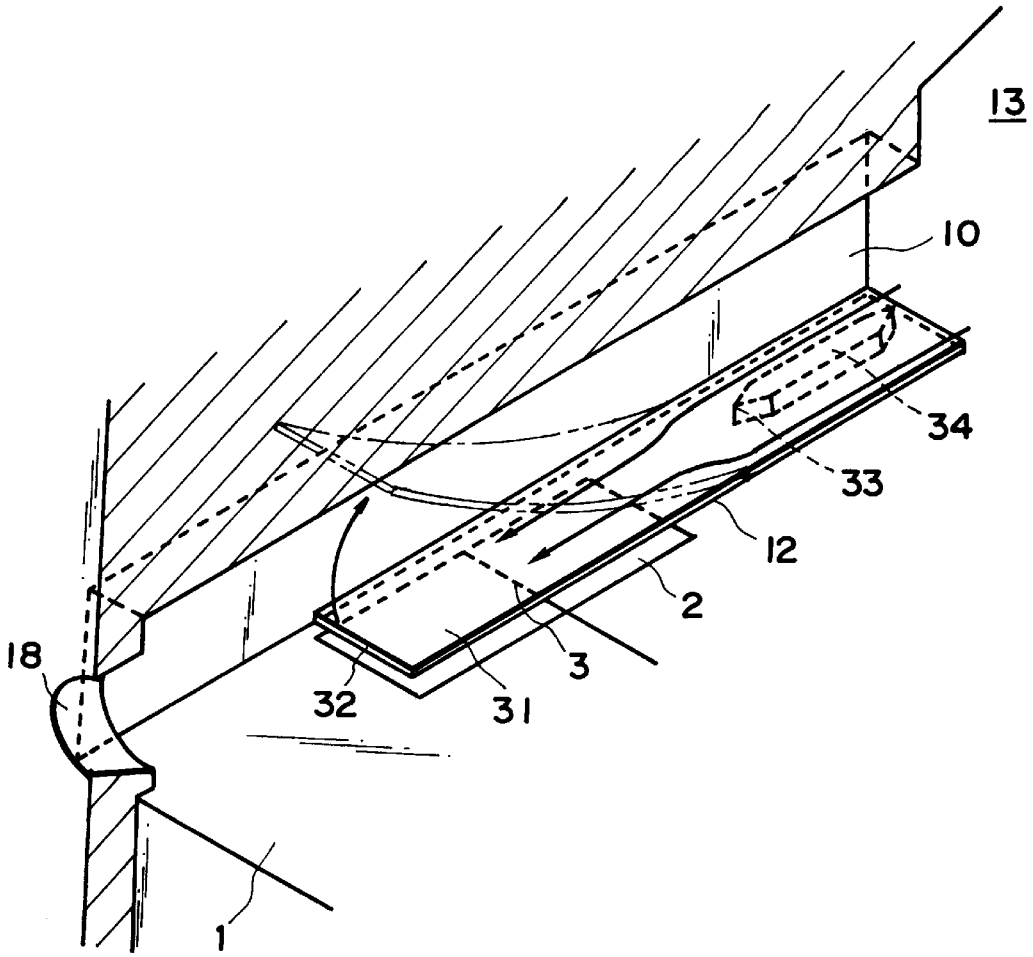
FIG. 7 is a partly broken perspective view of a liquid ejecting head according to a third embodiment of the present invention.

FIG. 7 shows one of the fundamental aspects of the present invention. FIG. 7 shows a positional relation among a bubble generation region, bubble and the movable member in one liquid flow path to further describe the liquid ejecting method and the refilling method according to an aspect of the present invention.

In the above described embodiment, the pressure by the generated bubble is concentrated on the free end of the movable member to accomplish the quick movement of the movable member and the concentration of the movement of the bubble to the ejection outlet side. In this embodiment, the bubble is relatively free, while a downstream portion of the bubble which is at the ejection outlet side directly contributable to the droplet ejection, is regulated by the free end side of the movable member.

More particularly, the projection (hatched portion) functioning as a barrier provided on the heat generating element substrate 1 of FIG. 2 is not provided in this embodiment. The free end region and opposite lateral end regions of the movable member do not substantially seal the bubble generation region relative to the ejection outlet region, but it opens the bubble generation region to the ejection outlet region, in this embodiment.

In this embodiment, the growth of the bubble is permitted at the downstream leading end portion of the downstream portions having direct function for the liquid droplet ejection, and therefore, the pressure component is effectively used for the ejection. Additionally, the upward pressure in this downstream portion (component forces $V_{B2}$, $V_{B3}$ and $V_{B4}$) acts such that the free end side portion of the movable member is added to the growth of the bubble at the leading end portion. Therefore, the ejection efficiency is improved similarly to the foregoing embodiments. As compared with the embodiment, this embodiment is better in the responsivity to the driving of the heat generating element.

The structure of this embodiment is simple, and therefore, the manufacturing is easy.

The fulcrum portion of the movable member 31 of this embodiment is fixed on one foundation 34 having a width smaller than that of the surface of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the third embodiment, both of the lateral sides (or only one lateral side) are substantially sealed for the bubble generation region 11. With such a structure, the pressure toward the lateral side of the movable member is also directed to the ejection outlet side end portion, so that the ejection efficiency is further improved.

<Embodiment 4>

Figure 8:
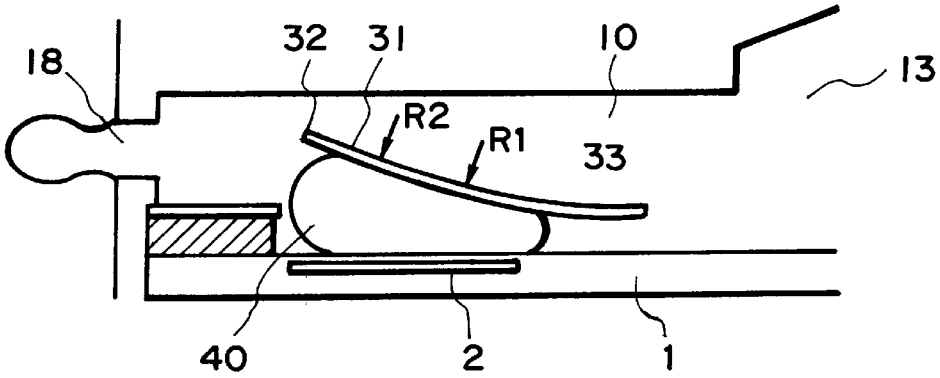
FIG. 8 is a sectional view of a liquid ejecting head according to a fourth embodiment of the present invention.

In the following embodiment, the ejection force for the liquid by the mechanical displacement is further improved. FIG. 8 is a cross-sectional view of this embodiment. In FIG. 8, the movable member is extended such that the position of the free end of the movable member 31 is positioned further downstream of the heat generating element. By this, the displacing speed of the movable member at the free end position is further increased, so that the generation of the ejection pressure by the displacement of the movable member is further improved.

In addition, the free end is closer to the ejection outlet side than in the foregoing embodiment, and therefore, the growth of the bubble can be concentrated toward the stabilized direction, thus assuring the better ejection.

The movable member 31 returns at a speed R1 by the elastic restoring force from the second position which is the maximum displacement position, wherein the free end 32 more remote than this position from the fulcrum 33 returns at a higher speed R2. By this, the high speed free end 32 mechanically acts on the bubble 40 during or after the growth of the bubble 40 to cause downstream motion (toward the ejection outlet) in the liquid downstream of the bubble 40, thus improving the direction of ejection and the ejection efficiency.

The free end configuration is such that, as is the same as in FIG. 7, the edge is vertical to the liquid flow, by which the pressure of the bubble and the mechanical function of the movable member are more efficiently contributable to the ejection.

<Embodiment 5>

FIGS. 9, (*a*), (*b*) and (*c*) illustrate a fifth embodiment of the present invention.

As is different from the foregoing embodiment, the region in direct communication with the ejection outlet is not in communication with the liquid chamber side, by which the structure is simplified.

The liquid is supplied only from the liquid supply passage 12 along the surface of the bubble generation region side of the movable member 31. The free end 32 of the movable member 31, the positional relation of the fulcrum 33 relative to the ejection outlet 18 and the structure of facing to the heat generating element 2 are similar to the above-described embodiment.

According to this embodiment, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble.

FIG. 9, (*a*) shows a state in which the bubble generation is caused by the heat generating element 2, and FIG. 9, (*b*) shows the state in which the bubble is going to contract. At this time, the returning of the movable member 31 to the initial position and the liquid supply by $S_3$ are effected.

In FIG. 9, (*c*), the small retraction M of the meniscus upon the returning to the initial position of the movable member, is being compensated for by the refilling by the capillary force in the neighborhood of the ejection outlet 18.

<Embodiment 6>

The description will be made as to another embodiment.

The ejection principle for the liquid in this embodiment is the same as in the foregoing embodiment. The liquid flow path has a multi-passage structure, and the liquid (bubble generation liquid) for bubble generation by the heat, and the liquid (ejection liquid) mainly ejected, are separated.

Figure 10:
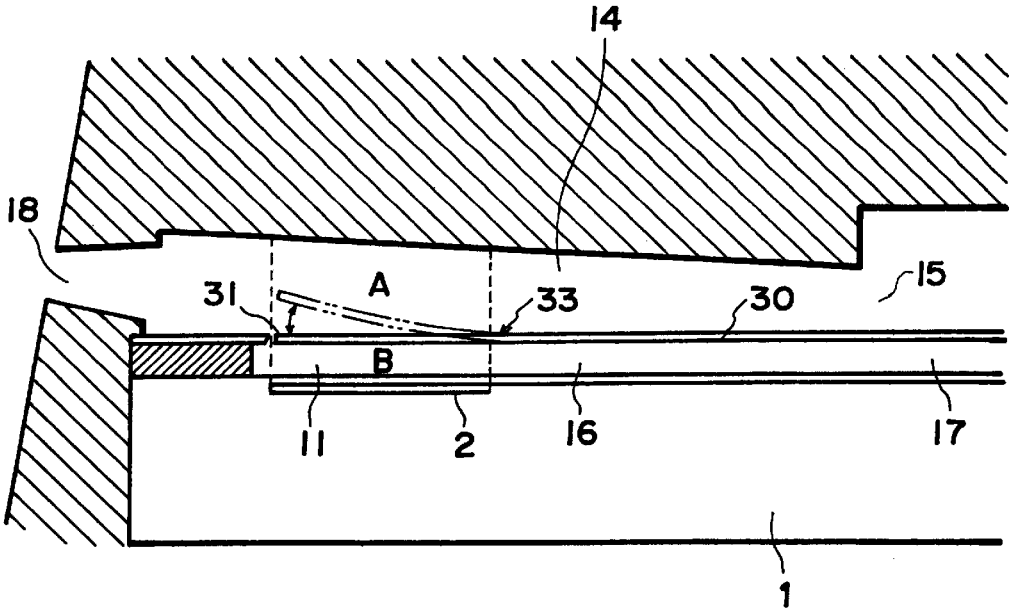
FIG. 10 is a sectional view of a liquid ejecting head (2 flow path) according to a sixth embodiment of the present invention.

FIG. 10 is a sectional schematic view in a direction along the flow path of the liquid ejecting head of this embodiment.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

A portion of the partition wall in the upward projection space of the heat generating element (ejection pressure generation region including A and B (bubble generation region 11) in FIG. 10), is in the form of a cantilever movable member 31, formed by slits 35, having a fulcrum 33 at the common liquid chamber (15, 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). In an example of FIG. 11, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 12A:
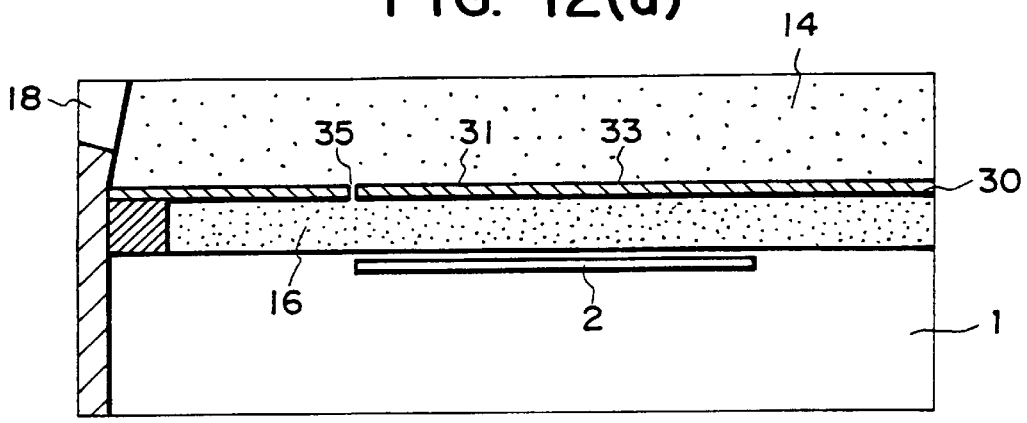
FIG. 12, consisting of FIGS. 12(*a*) through 12(*b*), illustrates an operation of a movable member.
Figure 12B:
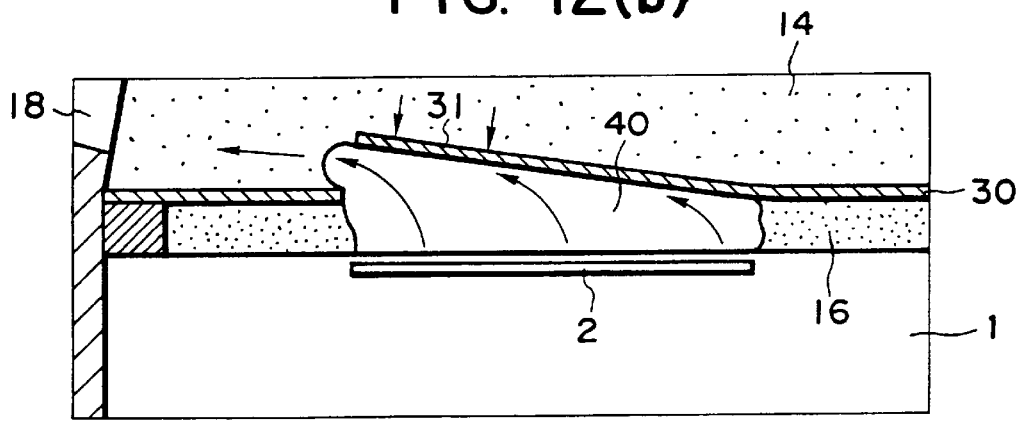

Referring to FIG. 12, the operation of the liquid ejecting head of this embodiment will be described.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that the pressure produced by the bubble generation is propagated concentratedly on the movable member 6 side in the election pressure generation portion, by which the movable member 6 is displaced from the position indicated in FIG. 12, (*a*) toward the first liquid flow path side as indicated in FIG. 12, (*b*) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 12, (*a*), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of the anol and water (4:6). By doing so, the ejection liquid can be properly ejected.

Additionally, by selecting as the bubble generation liquid a liquid with which the deposition such as burnt deposit does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

<Other Embodiments>

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

<Liquid Flow Path Ceiling Configuration>

Figure 13:
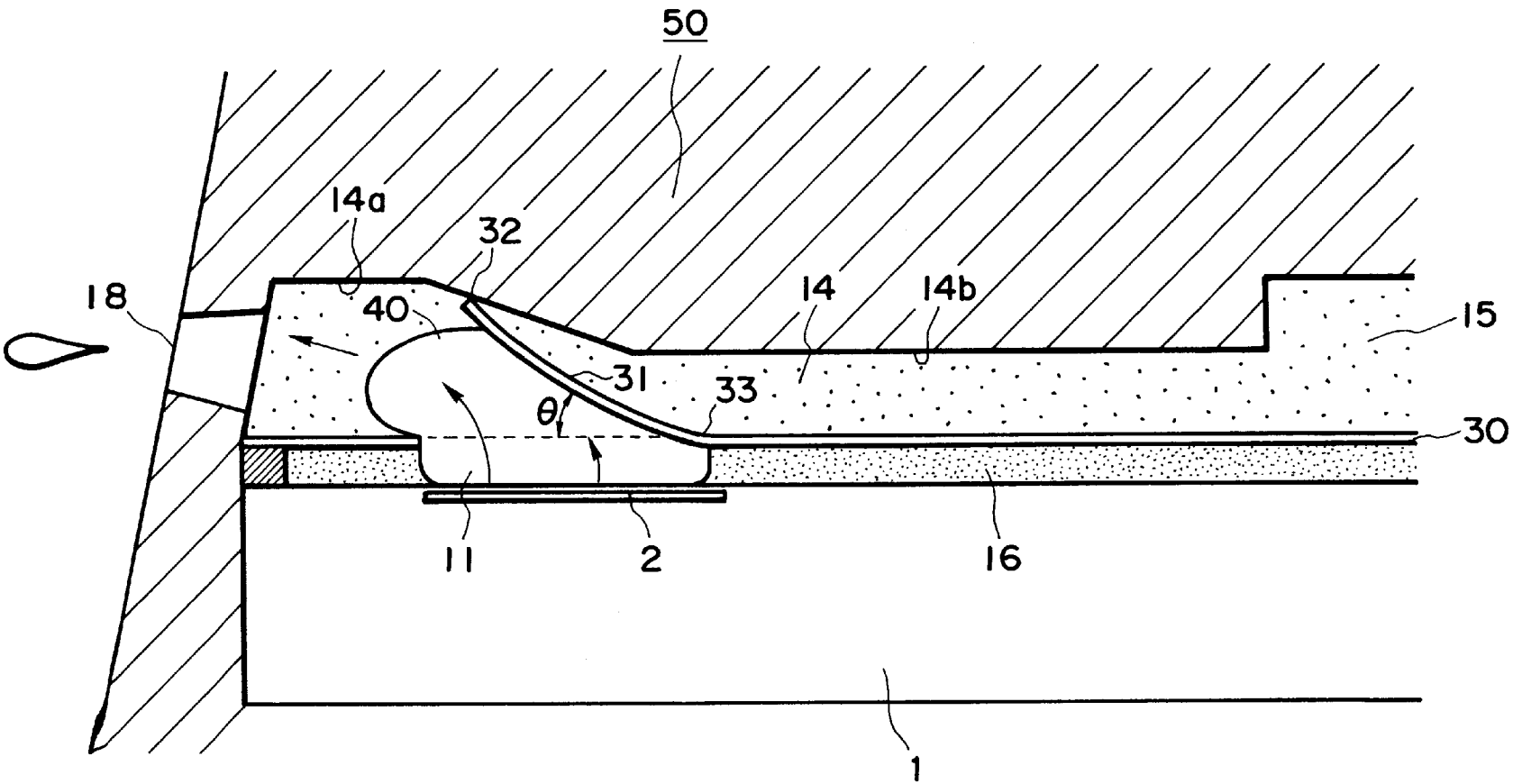
FIG. 13 illustrates a structure of a movable member and a first liquid flow path.
Figure 16:
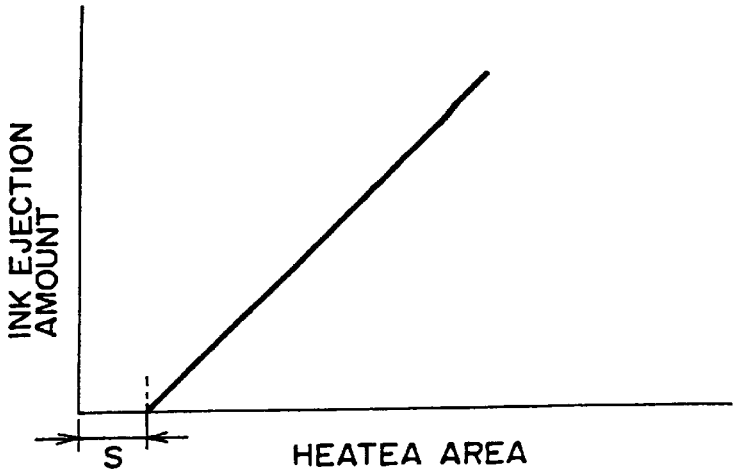
FIG. 16 shows a relation between an area of a heat generating element and an ink ejection amount.

FIG. 13 is a sectional view taken along the length of the flow path of the liquid ejecting head according to the embodiment. Grooves for constituting the first liquid flow paths 14 (or liquid flow paths 10 in FIG. 1) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can be further effectively prevented.

<Positional Relation Between Second Liquid Flow Path and Movable Member>

FIG. 14 is an illustration of a positional relation between the above-described movable member 31 and second liquid flow path 16, and (*a*) is a view of the movable member 31 position of the partition wall 30 as seen from the above, and (*b*) is a view of the second liquid flow path 16 seen from the above without partition wall 30. FIG. 14, (*c*) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that the filling amount of the bubble generation liquid to the bubble generation region 11 may be small. Therefore, the clearance at the throat portion 19 can be made very small, for example, as small as several μm–ten and several μm, so that the release of the pressure produced in the second liquid flow path can be further suppressed and to further concentrate it to the movable member side. The pressure can be used as the ejection pressure through the movable member 31, and therefore, the high k& ejection energy use efficiency and ejection pressure can be accomplished. The configuration of the second liquid flow path 16 is not limited to the one described above, but may be any if the pressure produced by the bubble generation is effectively transmitted to the movable member side.

As shown in FIG. 14, (*c*), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

It is preferable that the displacement start of the free end of the movable member occurs before the bubble contacts the movable member. This is accomplished by properly selecting the elasticity coefficient of the movable member, the pressure transmission properties of the bubble generation liquid and the ejection liquid, the driving condition for the bubble formation, each liquid passage structure or the like. More particularly, this can be accomplished more easily if the elastic deformation is easier, pressure propagation is quicker, a bubble growing speed is higher, and the flow resistance against the movable member is smaller. According to the present invention, the pressure wave produced by the bubble generation is directed toward the ejection outlet, so that the following growth of the bubble is permitted with high efficiency and certainty toward the ejection outlet side.

<Movable Member and Partition Wall>

FIG. 15 shows another example of the movable member 31, wherein reference numeral 35 designates a slit formed in the partition wall, and the slit is effective to provide the movable member 31. In FIG. 15, (*a*), the movable member has a rectangular configuration, and in (*b*), it is narrower in the fulcrum side to permit increased mobility of the movable member, and in (*c*), it has a wider fulcrum side to enhance the durability of the movable member. The configuration narrowed and arcuated at the fulcrum side is desirable as shown in FIG. 14. (*a*), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

When the ejection liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%. The percentage of the mixing can be controlled in the present invention by properly selecting the viscosities of the ejection liquid and the bubble generation liquid.

When the percentage is desired to be small, it can be reduced to 5%, for example, by using 5 CPS or lower fro the bubble generation liquid and 20 CPS or lower for the ejection liquid.

In this invention, the movable member has a thickness of μm order as preferable thickness, and a movable member having a thickness of cm order is not used in usual cases. When a slit is formed in the movable member having a thickness of μm order, and the slit has the width (W μm) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 12, 13 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

In the case that the bubble generation liquid and the ejection liquid are used as different function liquids, the movable member functions substantially as a partition or separation member between the liquids. When the movable member moves with the generation of the bubble, a small quantity of the bubble generation liquid may be introduced into the ejection liquid (mixture). Generally, in the ink jet recording, the coloring material content of the ejection liquid is 3% to 5% approx., and therefore, no significant density change results if the percentage of the bubble generation liquid mixed into the ejected droplet is not more than 20%. Therefore, the present invention covers the case where the mixture ratio of the bubble generation liquid of not more than 20%.

In the above-described structure, the mixing ratio of the bubble generation liquid was at most 15% even when the viscosity was changed. When the viscosity of the bubble generation liquid was not more than 5 cP, the mixing ratio was approx. 10% at the maximum, although it was dependent on the driving frequency.

When the viscosity of the ejection liquid is not more than 20 cP, the liquid mixing can be reduced (to not more than 5%, for example).

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

In a conventional bubble jet recording method, energy such as heat is applied to the ink to generate instantaneous volume change (generation of bubble) in the ink, so that the ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of kogation on the heat generating element, that is, the non-bubble-generation area S extends in the marginal area of the heat generating element. It is understood that the marginal approx. 4 μm width is not contributable to the bubble generation.

In order to effectively use the bubble generation pressure, it is preferable that the movable range of the movable member covers the effective bubble generating region of the heat generating element, namely, the inside area beyond the marginal approx. 4 μm width. In this embodiment, the effective bubble generating region is approx. 4μ and inside thereof, but this is different if the heat generating element and forming method is different.

Figure 17A:
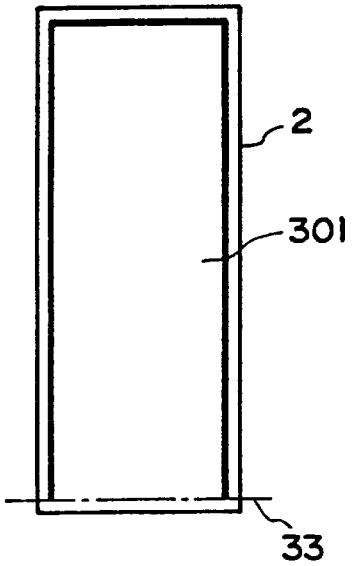
FIG. 17, consisting of FIGS. 17(*a*) and 17(*b*), shows a positional relation between a movable member and a heat generating element.
Figure 17B:
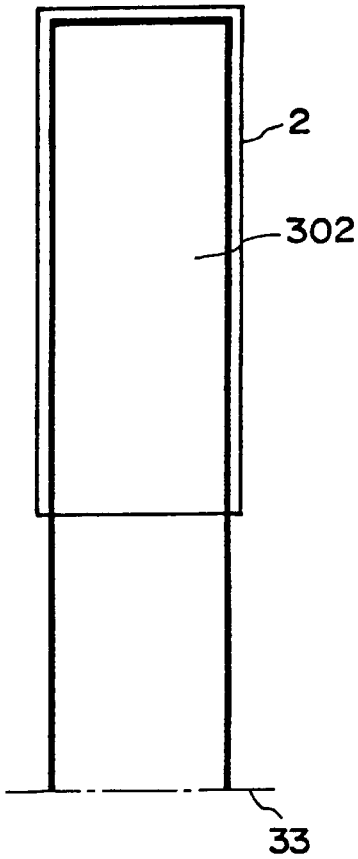
Figure 18:
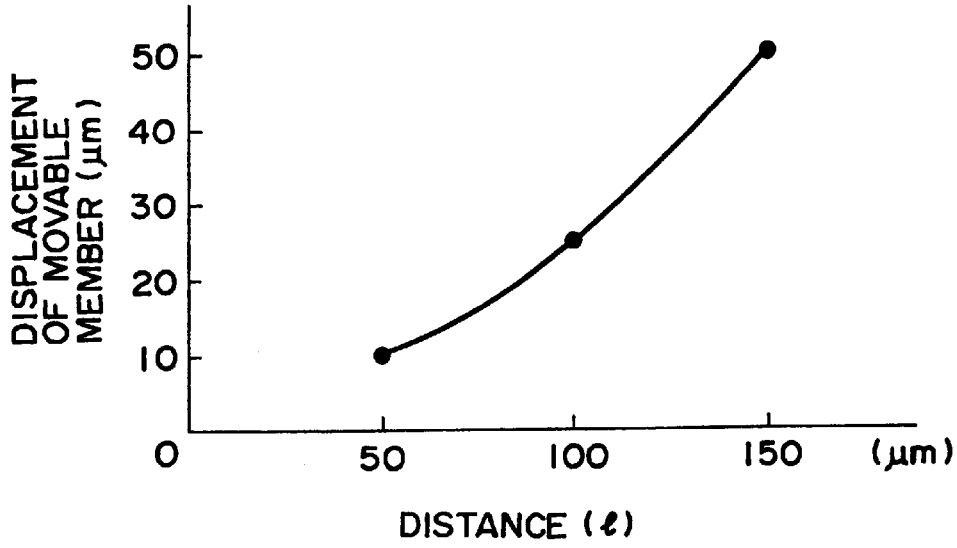
FIG. 18 shows a relation between a distance from an edge of a heat generating element to a fulcrum and a displacement of the movable member.

FIG. 17 is a schematic view as seen from the top, wherein the use is made with a heat generating element 2 of 58×150 μm, and with a movable member 301, FIG. 17, (*a*) and a movable member 302, FIG. 17, (*b*) which have different total area.

The dimension of the movable member 301 is 53×145 μm, and is smaller than the area of the heat generating element 2, but it has an area equivalent to the effective bubble generating region of the heat generating element 2, and the movable member 301 is disposed to cover the effective bubble generating region. On the other hand, the dimension of the movable member 302 is 53×220 μm, and is larger than the area of the heat generating element 2 (the width dimension is the same, but the dimension between the fulcrum and movable leading edge is longer than the length of the heat generating element), similarly to the movable member 301. It is disposed to cover the effective bubble generating region. The tests have been carried out with the two movable members 301 and 302 to check the durability and the ejection efficiency. The conditions were as follows:

Bubble generation liquid: Aqueous solution of ethanol (40%)

Ejection ink: dye ink

Voltage: 20.2 V

Frequency: 3 kHz

The results of the experiments show that the movable member 301 was damaged at the fulcrum when $1\times10^7$ pulses were applied. The movable member 302 was not damaged even after $3\times10^8$ pulses were applied. Additionally, the ejection amount relative to the supplied energy and the kinetic energy determined by the ejection speed, are improved by approx. 1.5–2.5 times.

<Element Substrate>

The description will be made as to a structure of the element substrate provided with the heat generating element for heating the liquid.

Figure 20A:
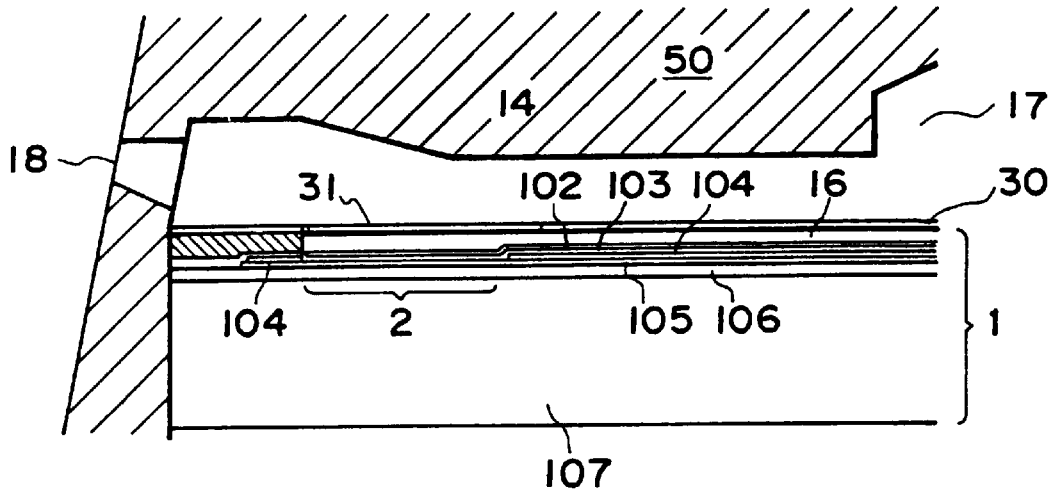
FIG. 20, consisting of FIGS. 20(*a*) and 20(*b*), is a longitudinal sectional view of a liquid ejecting head of the present invention.
Figure 20B:
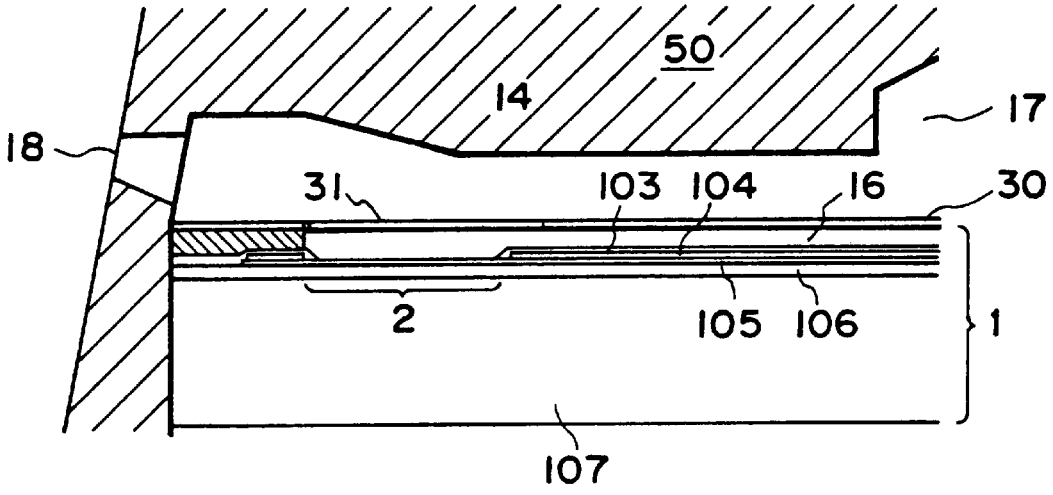

FIG. 20 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

Figure 11:
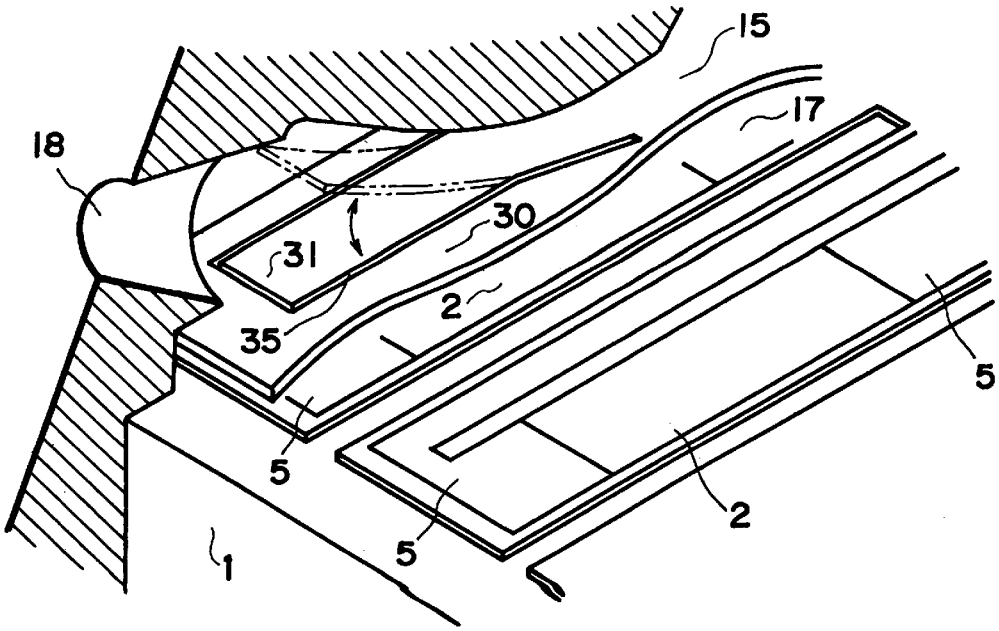
FIG. 11 is a partly broken perspective view of a liquid ejecting head according to a sixth embodiment of the present invention.

The element substrate 1 has, as shown in FIG. 11, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 4, (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 21:
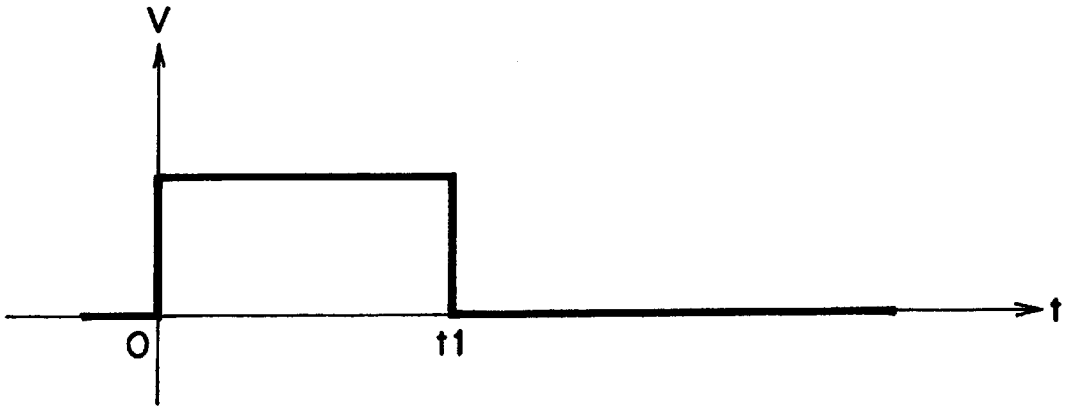
FIG. 21 is a schematic view showing a configuration of a driving pulse.

In order to eject the liquid by driving the heat generation portion of the electrothermal transducer on the above-described element substrate 1, the resistance layer 105 is supplied through the wiring electrode 104 with rectangular pulses as shown in FIG. 21 to cause instantaneous heat generation in the resistance layer 105 between the wiring electrode. In the case of the heads of the foregoing embodiments, the applied energy has a voltage of 24 V, a pulse width of 7 μsec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

Head Structure of 2 Flow Path Structure

The description will be made as to a structure of the liquid ejecting head with which different liquids are separately accommodated in first and second common liquid chamber, and the number of parts can be reduces so that the manufacturing cost can be reduced.

Figure 22:
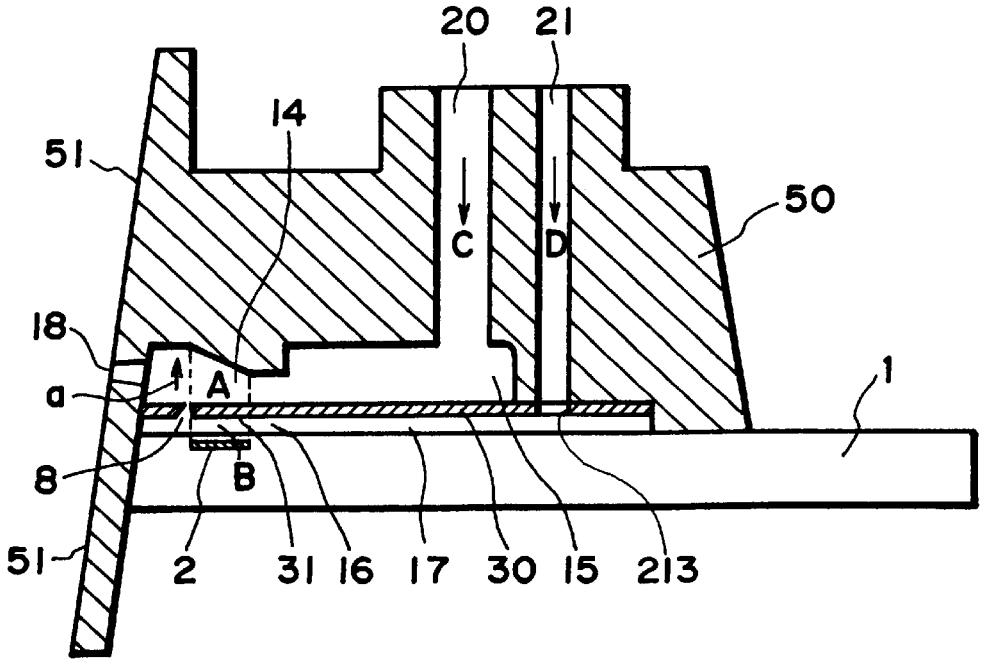
FIG. 22 is a sectional view illustrating a supply passage of a liquid ejecting head of the present invention.

FIG. 22 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 22, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 21.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

Figure 23:
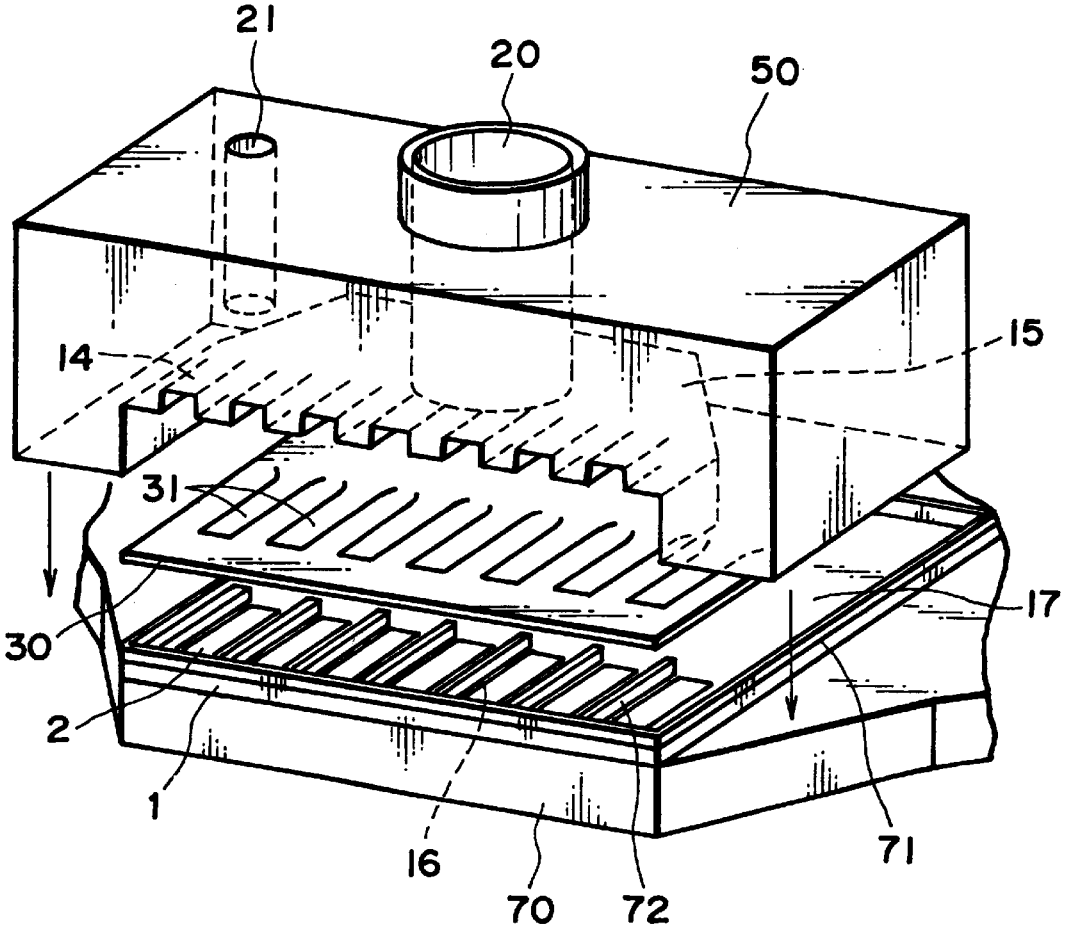
FIG. 23 is an exploded perspective view of a liquid ejecting head of the present invention.

The second common liquid chamber 17 may be formed by dividing the grooved by a separation wall 30. As for the method of forming this, as shown in FIG. 23 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second common liquid chamber 17. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

Ejection Liquid and Bubble Generation Liquid

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n- n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded. Dye ink viscosity of 2 cp:

| | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| | |
|---|---|
| Bubble generation liquid 1: | |
| Ethanol | 40 wt. % |
| Water | 60 wt % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: | |
| (Pigment in approx. 15 cp) Carbon black | 5 wt. % |
| Stylene-acrylate-acrylate ethyl copolymer resin material | 1 wt. % |
| Dispersion material (oxide 140, weight average molecular weight) Mono-ethanol amine | 0.25 wt. % |
| Glyceline | 69 wt. % |
| Thiodiglycol | 5 wt. % |
| Ethanol | 3 wt. % |
| Water | 16.75 wt. % |

-continued

| | |
|---|---|
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

Manufacturing of Liquid Ejecting Head

The description will be made as to the manufacturing step of the liquid ejecting head according to the present invention.

In the case of the liquid ejecting head as shown in FIG. 2, a foundation 34 for mounting the movable member 31 is patterned and formed on the element substrate 1, and the movable member 31 is bonded or welded on the foundation 34. Then, a grooved member having a plurality of grooves for constituting the liquid flow paths 10, ejection outlet 18 and a recess for constituting the common liquid chamber 13, is mounted to the element substrate1 with the grooves and movable members aligned with each other.

The description will be made as to a manufacturing step for the liquid ejecting head having the two-flow-path structure as shown in FIG. 10 and FIG. 23.

Generally, walls for the second liquid flow paths 16 are formed on the element substrate1, and separation walls 30 are mounted thereon, and then, a grooved member 50 having the grooves for constituting the first liquid flow paths 14, is mounted further thereon. Or, the walls for the second liquid flow paths 16 are formed, and a grooved member 50 having the separation walls 30 is mounted thereon.

The description will be made as to the manufacturing method for the second liquid flow path.

FIGS. 24, (a)–(e), is a schematic sectional view for illustrating a manufacturing method for the liquid ejecting head according to a first manufacturing embodiment of the present invention.

In this embodiment, as shown in FIG. 24, (a), elements for electrothermal conversion having heat generating elements 2 of hafnium boride, tantalum nitride or the like, are formed, using a manufacturing device as in a semiconductor manufacturing, on an element substrate (silicon wafer) 1, and thereafter, the surface of the element substrate 1 is cleaned for the purpose of improving the adhesiveness or contactness with the photosensitive resin material in the next step. In order to further improve the adhesiveness or contactness, the surface of the element substrate is treated with ultraviolet-radiation-ozone or the like. Then, liquid comprising a silane coupling agent, for example, (A189, available from NIPPON UNICA) diluted by ethyl alcoholic to 1 weight % is applied on the improved surface by spin coating.

Subsequently, the surface is cleaned, and as shown in FIG. 24, (b), an ultraviolet radiation photosensitive resin film (dry film Ordyl SY-318 available from Tokyo Ohka Kogyo Co., Ltd.) DF is laminated on the substrate1 having the thus improved surface.

Then, as shown in FIG. 24, (c), a photo-mask PM is placed on the dry film DF, and the portions of the dry film DF which are to remain as the second flow passage wall is illuminated with the ultraviolet radiation through the photomask PM. The exposure process was carried out using MPA-600, available from, CANON KABUSHIKI KAISHA), and the exposure amount was approx. 600 $mJ/cm^2$.

Then, as shown in FIG. 24, (d), the dry film DF was developed by developing liquid which is a mixed liquid of xylene and butyl Cellosolve acetate (BMRC-3 available from Tokyo Ohka Kogyo Co., Ltd.) to dissolve the unexposed portions, while leaving the exposed and cured portions as the walls for the second liquid flow paths 16. Furthermore, the residuals remaining on the surface of the element substrate 1 is removed by oxygen plasma ashing device (MAS-800 available from Alcan-Tech Co., Inc.) for approx. 90 sec, and it is exposed to ultraviolet radiation for 2 hours at 150° C. with the dose of 100 $mJ/cm_2$ to completely cure the exposed portions.

Figure 19:
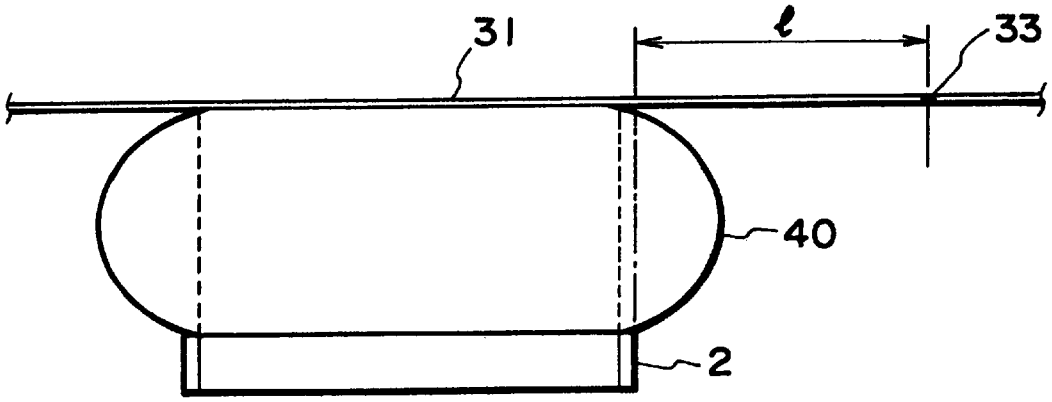
FIG. 19 illustrates a positional relation between a heat generating element and a movable member.

By this method, the second liquid flow paths can be formed with high accuracy on a plurality of heater boards (element substrates) cut out of the silicon substrate. The silicon substrate is cut into respective heater boards 1 by a dicing machine having a diamond blade of a thickness of 0.05 mm (AWD-4000 available from Tokyo Seimitsu). The separated heater boards 1 are fixed on the aluminum base plate 70 by adhesive material (SE4400 available from Toray), FIG. 19. Then, the printed board 71 connected to the aluminum base plate 70 beforehand is connected with the heater board 1 by aluminum wire (not shown) having a diameter of 0.05 mm.

As shown in FIG. 24, (e), a joining member of the grooved member 50 and separation wall 30 were positioned and connected to the heater board 1. More particularly, grooved member having the separation wall 30 and the heater board 1 are positioned, and are engaged and fixed by a confining spring. Thereafter, the ink and bubble generation liquid supply member 80 is fixed on the ink. Then, the gap among the aluminum wire, grooved member 50, the heater board1 and the ink and bubble generation liquid supply member 80 are sealed by a silicone sealant (TSE399, available from Toshiba silicone).

By forming the second liquid flow path through the manufacturing method, accurate flow paths without positional deviation relative to the heaters of the heater board, can be provided. By coupling the grooved member50 and the separation wall 30 in the prior step, the positional accuracy between the first liquid flow path 14 and the movable member 31 is enhanced.

By the high accuracy manufacturing technique, the ejection stabilization is accomplished, and the printing quality is improved. Since they are formed all together on a wafer, massproduction at low cost is possible.

In this embodiment, the use is made with an ultraviolet radiation curing type dry film for the formation of the second liquid flow path. But, a resin material having an absorption band adjacent particularly 248 nm (outside the ultraviolet range) may be laminated. It is cured, and such portions going to be the second liquid flow paths are directly removed by excimer laser.

FIGS. 25, (a)–(d), is a schematic sectional view for illustration of a manufacturing method of the liquid ejecting head according to a second embodiment of the present invention.

In this embodiment, as shown in FIG. 25, (a), a resist 101 having a thickness of 15 μm is patterned in the shape of the second liquid flow path on the SUS substrate 100.

Then, as shown in FIG. 25, (b), the SUS substrate 20 is coated with 15 μm thick of nickel layer 102 on the SUS substrate 100 by electroplating. The plating solution used comprised nickel amidosulfate nickel, stress decrease material (zero ohru, available from World Metal Inc.), boric acid, pit prevention material (NP-APS, available from World Metal Inc.) and nickel chloride. As to the electric field upon electro-deposition, an electrode is connected on the anode side, and the SUS substrate 100 already patterned is connected to the cathode, and the temperature of the plating solution is 50° C., and the current density is 5 A/cm$^2$.

Then, as shown in FIG. 25, (c), the SUS substrate 100 having been subjected to the plating is subjected then to ultrasonic vibration to remove the nickel layer 102 portions from the SUS substrate 100 to provide the second liquid flow path.

On the other hand, the heater board having the elements for the electrothermal conversion, are formed on a silicon wafer by a manufacturing device as used in semiconductor manufacturing. The wafer is cut into heater boards by the dicing machine similarly to the foregoing embodiment. The heater board 1 is mounted to the aluminum base plate 70 already having a printed board 104 mounted thereto, and the printed board 7 and the aluminum wire (not shown) are connected to establish the electrical wiring. On such a heater board 1, the second liquid flow path provided through the foregoing process is fixed, as shown in FIG. 25, (d). For this fixing, it may not be so firm if a positional deviation does not occur upon the top plate joining, since the fixing is accomplished by a confining spring with the top plate having the separation wall fixed thereto in the later step, as in the first embodiment.

In this embodiment, for the positioning and fixing, the use was made with an ultraviolet radiation curing type adhesive material (Amicon UV-300, available from GRACE JAPAN), and with an ultraviolet radiation projecting device operated with the exposure amount of 100 mJ/cm$^2$ for approx. 3 sec to complete the fixing.

According to the manufacturing method of this embodiment, the second liquid flow paths can be provided without positional deviation relative to the heat generating elements, and since the flow passage walls are of nickel, it is durable against the alkali property liquid so that the reliability is high.

FIGS. 25, (a)–(d), is a schematic sectional view for illustrating a manufacturing method of the liquid ejecting head according to a third embodiment of the present invention.

In this embodiment, as shown in FIG. 25, (a), the resist 31 is applied on both of the sides of the SUS substrate 100 having a thickness of 15 μm and having an alignment hole or mark 100*a*. The resist used was PMERP-AR900 available from Tokyo Ohka Kogyo Co., Ltd.

Thereafter, as shown in (b), the exposure operation was carried out in alignment with the alignment hole 100*a* of the element substrate 100, using an exposure device (MPA-600 available from CANON KABUSHIKI KAISHA, JAPAN) to remove the portions of the resist 103 which are going to be the second liquid flow path. The exposure amount was 800 mJ/cm$^2$.

Subsequently, as shown in (c), the SUS substrate 100 having the patterned resist 103 on both sides, is dipped in etching liquid (aqueous solution of ferric chloride or cuprous chloride) to etch the portions exposed through the resist 103, and the resist is removed.

Then, as shown in (d), similarly to the foregoing embodiment of the manufacturing method, the SUS substrate 100 having been subjected to the etching is positioned and fixed on the heater board1, thus assembling the liquid ejecting head having the second liquid flow paths 4.

According to the manufacturing method of this embodiment, the second liquid flow paths 4 without the positional deviation relative to the heaters can be provided, and since the flow paths are of SUS, the durability against acid and alkali liquid is high, so that high reliability liquid ejecting head is provided.

As described in the foregoing, according to the manufacturing method of this embodiment, by mounting the walls of the second liquid flow path on the element substrate in a prior step, the electrothermal transducers and second liquid flow paths are aligned with each other with high precision. Since a number of second liquid flow paths are formed simultaneously on the substrate before the cutting, massproduction is possible at low cost.

The liquid ejecting head provided through the manufacturing method of this embodiment has the advantage that the second liquid flow paths and the heat generating elements are aligned at high precision, and therefore, the pressure of the bubble generation can be received with high efficiency so that the ejection efficiency is excellent.

The description will be made as to a seventh embodiment of the liquid ejecting head of the present invention. This embodiment is particularly directed to the liquid-repellencies of the surfaces of the separation wall.

FIG. 27 is an illustration of a liquid ejecting head having a plurality of ejection outlets and liquid flow paths wherein the second liquid flow path namely the bubble generation liquid flow path is made of DRY FILM, and (a) is a partly broken perspective view, and (b) is a sectional view of a part of the separation wall. In FIG. 27, (a), the liquid ejecting head is provided with a substrate 1 having a plurality of heat generating elements 2, a separation wall 30 defining the second liquid flow path 16 and having the above-described movable members 31 for respective heat generating resistors, and a grooved member (top plate) 50, on the separation wall 30, provided with a first liquid flow passage wall 22 for defining the first liquid flow path 14. Designated by 24 is a projection, and 51 is an orifice plate. The separation wall 30 has a first surface portion 30A contacted to the ejection liquid (ejection ink) which is the first liquid accommodated in the first region as shown in FIG. 27, (b), and a second surface portion 30B contacted to the bubble generation liquid which is the second liquid accommodated in the second region, wherein the liquid-repellencies of the surfaces are different from each other. The first surface portion 30A and the second surface portion 30B may be integral with the separation wall 30 or may be a separate member.

In this example, a DRY FILM 19 having a thickness of 15 μm is placed on the substrate and is patterned so as to form a flow passage wall defining the second liquid flow paths 16. However, the material of the flow passage wall is not limited to this, but may be any if it has an anti-solvent property against the bubble generation liquid and is easy to form into the flow passage wall configuration. Examples of the materials include, liquid resist, polysulfone polyethylene resin, gold, silicon, nickel or another metal, glass or the like, in addition to the DRY FILM.

The first liquid flow path 14 and so on are formed by connecting the separation wall 30 and the top plate 50 which is provided with an orifice plate 51 having the ejection outlets 18, a recess constituting the first liquid flow paths 14 and constituting a first common liquid chamber 15, commonly in communication with the first liquid flow paths 14, for supplying the first liquid to the liquid flow paths.

The top plate may have a projection for coupling with the separation wall having the movable members and the bubble generation liquid supply port. The top plate configuration for fixing the separation wall having the movable members is not limited to the above-described, but may be any if the separation wall having the movable portions can be effectively fixed temporally.

The separation wall 30 having the movable members is of nickel having a thickness of 5 μm, but the material of the separation wall may be any if it has an anti-solvent property against the ejection liquid and the bubble generation liquid, and it has an elasticity to permit proper operation of the movable member, and it permits formation of fine slits. Examples of the materials include nickel, gold or another metal, or polyethylene or another resin material. The thickness of the separation wall is preferably 0.1 μm–10 μm approx. But it may be different if it can provide sufficient strength as the separation wall, and it permits proper operation as the movable member, in consideration of the material, configuration and so on thereof.

The width of the slit for forming the movable member is 2 μm in this example.

The slit 35 may be formed by etching or laser beam.

Figure 28:
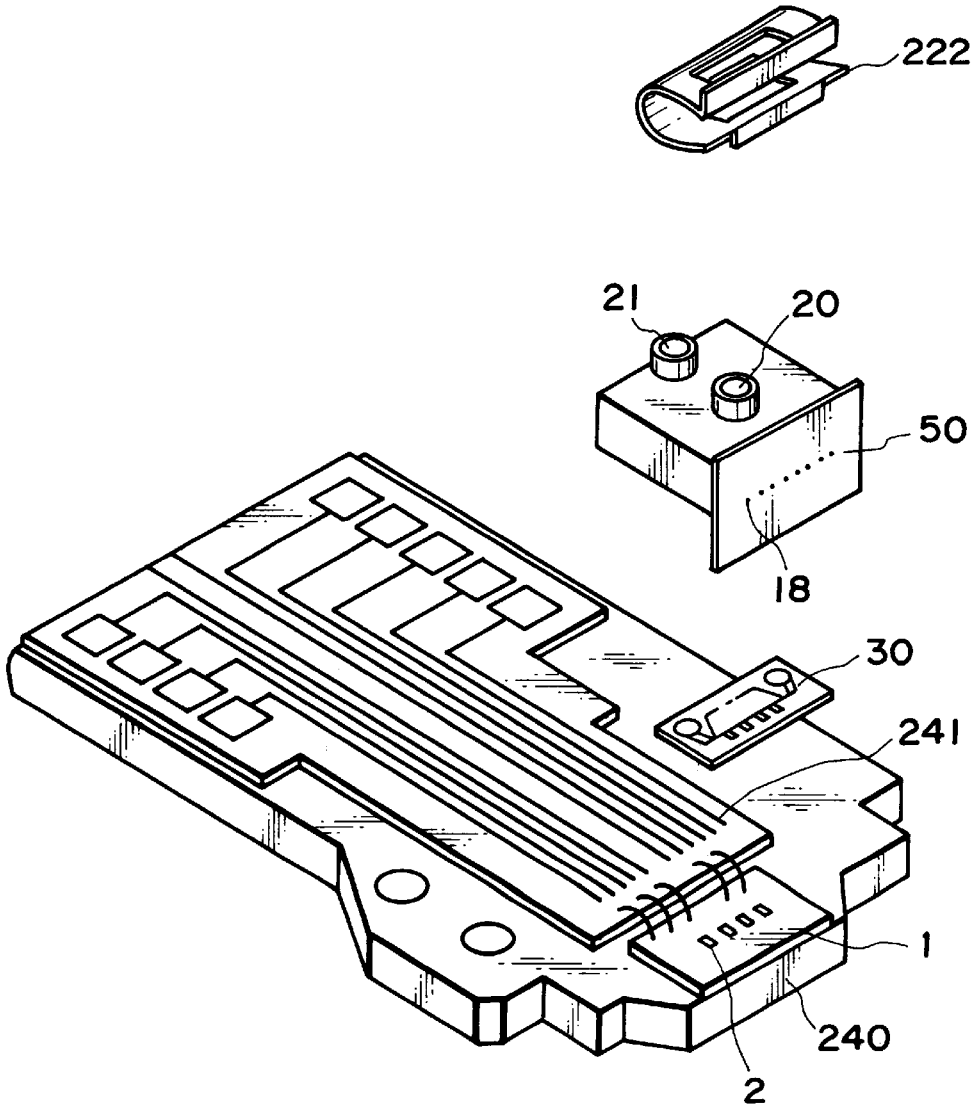
FIG. 28 is a general arrangement of a head of the present invention.

The head is assembled as shown in FIG. 28. The top plate 50 is fixed up side down, and the separation wall 30 having the movable members is placed thereon using vacuum pump (unshown). Then, micro adjustment is carried out to align them, whereafter it is fitted into the top plate, and is temporarily fixed using adhesive material if desired. The separation wall 30 may have the movable members, or may have a groove for positioning the ejection liquid flow paths of the top plate, the bubble generation liquid flow paths and the movable members. Then, the top plate having the separation wall having the movable member, is disposed on the aluminum base plate 240 using conventional point contacting machine, and the positions of the energy generating elements 2 on the substrate 1 connected to the PCB printed board 241 by aluminum wire, are measured on an image on a monitor provided by a TV camera or the like. While moving the top plate 150 at a predetermined position on a stage, the position thereof is similarly measured on the monitor to align the energy generating elements 2 and the ejection outlets 18. Then, the top plate 105 and the substrate 1 are cramped by a spring 220. The substrate 1 may be a bare heater board or may be provided with bubble generation liquid flow paths.

The separation wall having the movable members has a bubble generation liquid supply port (213 in FIG. 22). In this example, the diameter of the bubble generation liquid supply port in the separation wall was 0.8 mm, and the diameter of the bubble generation liquid supply port (21 in FIG. 22) in the top plate was 0.6 mm. By making the bubble generation liquid supply port in the top plate smaller than the bubble generation liquid supply port in the separation wall having the movable members, the flowing of a sealant into the supply port can be prevented afterward.

The harmeticality of the first common liquid chamber 15 and the second common liquid chamber 17 (FIG. 30, 27) is provided by formation of a wall by the sealant therearound.

In this example, the head disclosed in FIG. 27 was used, and the bubble generation liquid was a mixture of the ethanol and water, and The ejection liquid was dye ink (2 cP), pigment ink (15 cP), polyethylene glycol 200 (55 cP), or polyethylene glycol 600 (150 cP). The head was driven with a voltage of 25 V at 2.5 kHz, and it was confirmed that the good ejection is performed, and the resultant images were of high quality.

Fourth Embodiment of Manufacturing Method

Figure 29:
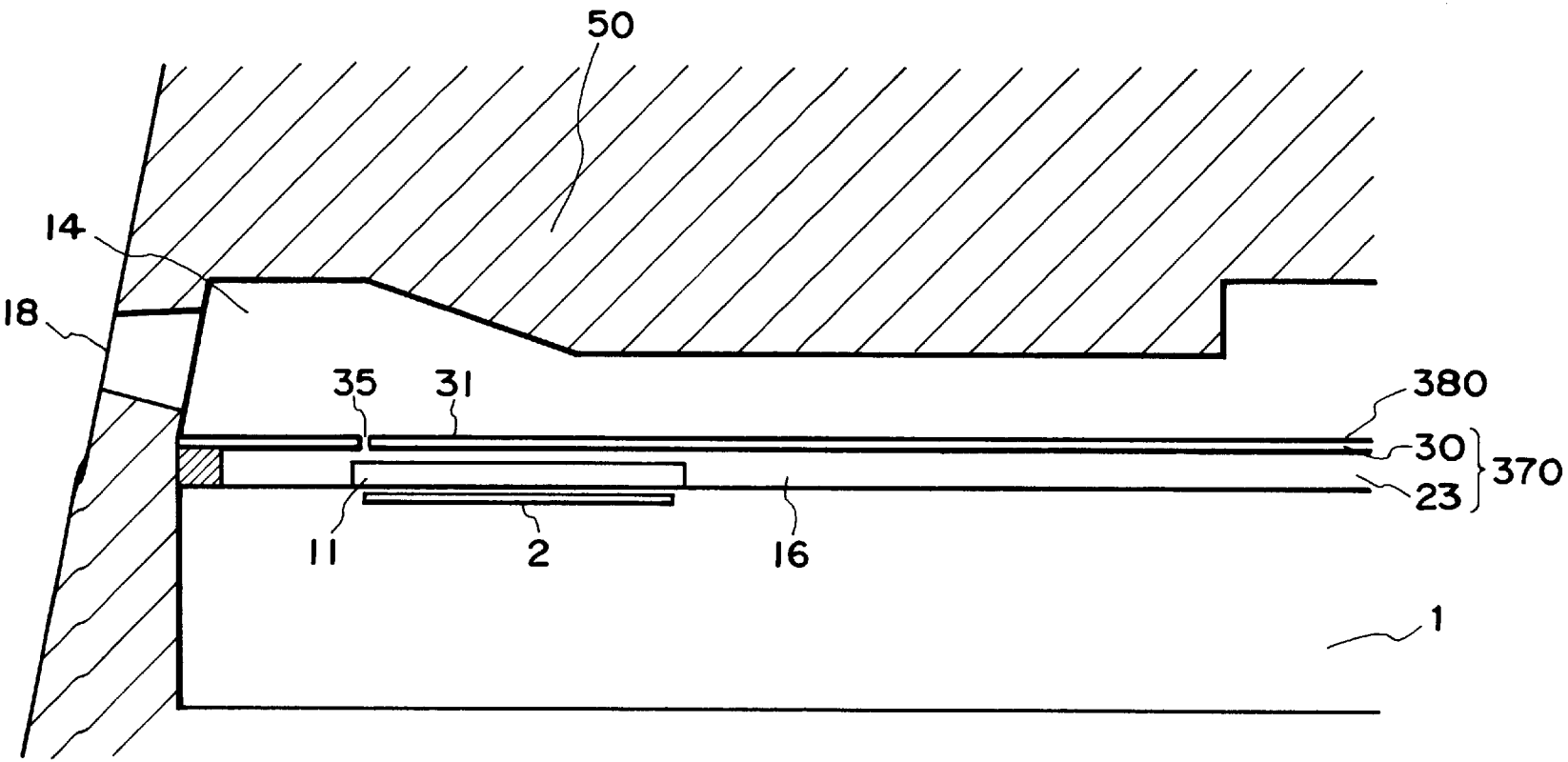
FIG. 29 is a sectional view of a liquid ejecting head of the present invention wherein it is integrally formed with the bubble generation liquid flow path.

FIG. 29 is a sectional view of an ink jet recording head according to seventh embodiment. A separation wall 30 partitions a first liquid flow path 14 containing ejection ink and a second liquid flow path 16 containing bubble generation liquid from each other, and has a movable member 31. The separation wall 30 and a flow passage wall 23 for the bubble generation liquid are integrally formed, and the integral member 370 is disposed on the heater board 1 having a heater 2, so that the movable member 31 is right above the heater 2. A top plate 50 having an ejection ink flow path (first liquid flow path) 14 and an ejection outlet 18 is positioned on the separation wall 30 coated with water repelling material 380, and they are cramped by a cramping spring, thus constituting the ink jet recording head.

In this example, the bubble generation liquid flow passage wall 23 and the separation wall 30 are integrally formed (370) by electro-forming, and the water repelling material 380 is applied to the ejection ink side. However, this structure is not limiting, and laser machining, etching, electro-forming and the like are usable alone or in combination. The bubble generation liquid flow path and the separation wall may be separately formed, and may then be coupled. The material is not limited to nickel, but any is usable if it has an anti-solvent property, and is suitable to function as the movable member 31. For example, metal, plastic resin material and so on may be usable alone or in combination.

The configuration and thickness thereof may be any if the free end of the movable member displaces or deflects to an extent necessary for the ink ejection in association with the heater size and its configuration upon bubble generation.

In the embodiment of the present invention, the thickness of the movable member was 5 μm; the distance between movable member and the heater was 15 μm. With these dimensions, sufficient functions were performed.

The water repellency provided by the water repelling material is substantially independent from the thickness of the water repelling material layer, and the thickness of the water repelling material layer is normally sufficient if it is 0.1 μm–2 μm approx. Preferably, it is 0.1 μm–1 μm.

FIG. 30 shows an example and water repelling material application method according to a fourth embodiment of the manufacturing method for the liquid ejecting head wherein the bubble generation liquid flow path and the separation wall are formed by repeating the electro-forming.

On such a portion of a SUS substrate 400 as is going to be a bubble generation liquid flow path, a patterning is effected by resist 410 into a thickness of 15 μm (FIG. 30, (a)). Thereafter, electroplating is effected, so that the nickel 420 grows by 15 μm (FIG. 30, (b)).

Subsequently, the portion which is going to be the movable member is patterned by resist 430 (FIG. 30, (c)), and the nickel 440 grows to 5 μm, similarly (FIG. 30, (d)). Thus, a nickel plate 450 is formed.

After the plating, and before the SUS substrate 400 and the nickel plate 450 are separated from each other, all surfaces of the nickel plate 450 or the movable member portion and the marginal portion thereof is coated with water repelling material 460 (FIG. 30, (e)). The used water repelling material was SAITOP (Asahi Glass Kabushiki Kaisha), but anther material of fluorine or silicone type is usable if it has an anti-solvent property, and is not deteriorated by the ejection ink. After water repelling material application, it is dried, and the resist is removed. When the SUS substrate 400 and the nickel plate 450 are separated from each other, a structure having the second liquid flow path 16, the slit 35 and the movable member 470, is provided (FIG. 30, (f)).

In the foregoing manner, an integral member of bubble generation liquid flow path—and separation wall, having a low liquid repellency at the bubble generation liquid flow path side and a high liquid repellency at the liquid repellency ink side, are provided. FIG. 31 is a sectional view of an ink jet recording head in this example, as seen from the ejection outlet side. The nickel plate 450, water repelling material 460 and movable member 470 correspond to 370, 380 and 31 of FIG. 29, respectively. The flow passage wall 490 corresponds to the flow passage wall 22 of FIG. 27, (a). In this case, the contact angle of the nickel relative to the water is 0 degrees, and therefore, it is very easily wet. However, by the application of the water repelling material (SAITOP), the contact angle is increased to 110 degrees (high liquid-repellency) so that a meniscus is easily maintained in the slit portion 35.

Thus, the entering of the ejection ink into the bubble generation liquid chamber can be prevented effectively in the slit portion for movable member formation. Additionally, the liquid-repellency is low in the bubble generation liquid chamber, and therefore, the refilling of the bubble generation liquid is easy so that the ejection is stabilized.

Fifth Embodiment of Manufacturing Method

The description will be made as to a fifth embodiment of the manufacturing method for a liquid ejecting head according to the present invention.

With the ink jet recording head of the seventh embodiment, the water repelling material application was effected after only the resist for the movable member formation is removed, as shown in FIG. 32. The detailed description will be made, referring to FIG. 32. Similarly to embodiment, an integral member of the bubble generation liquid flow path—separation wall is formed. The steps corresponding to FIG. 30, (a)–(d) are carried out. A resist 510 is patterned for the portion which is going to be the bubble generation liquid flow path on the SUS substrate 500 into 15 $\mu$m thickness. Thereafter, the electroplating is carried out so that the nickel grows to 15 $\mu$m. Then, a pattern is formed with resist 530 at the portion for forming the movable member (the portion to be a slit for defining the movable member), and the nickel is caused to grow to 5 $\mu$m, similarly so as to provide a nickel plate 550 (FIG. 32, (a)). Subsequently, only the resist 530 for the movable member formation is removed with time adjustment. As shown in FIG. 32, (c), a water repelling material (SAITOP, available from Asahi Glass Kabushiki Kaisha kabushiki kaisha) 560 is applied on all the surface or on the movable member and the marginal area thereof. At this time, the water repelling material 560 is applied to a side surface of the slit portion for the movable member formation.

After the water repelling material is dried, the rest of the resist is removed, and, the SUS substrate and the nickel plate are separated from each other. By this, a structure is provided which has a movable portion 570, a second liquid flow path 16, a slit portion 35, and a layer of the water repelling material 560 on the first liquid flow path side and and on the slit portion 35.

Figure 33:
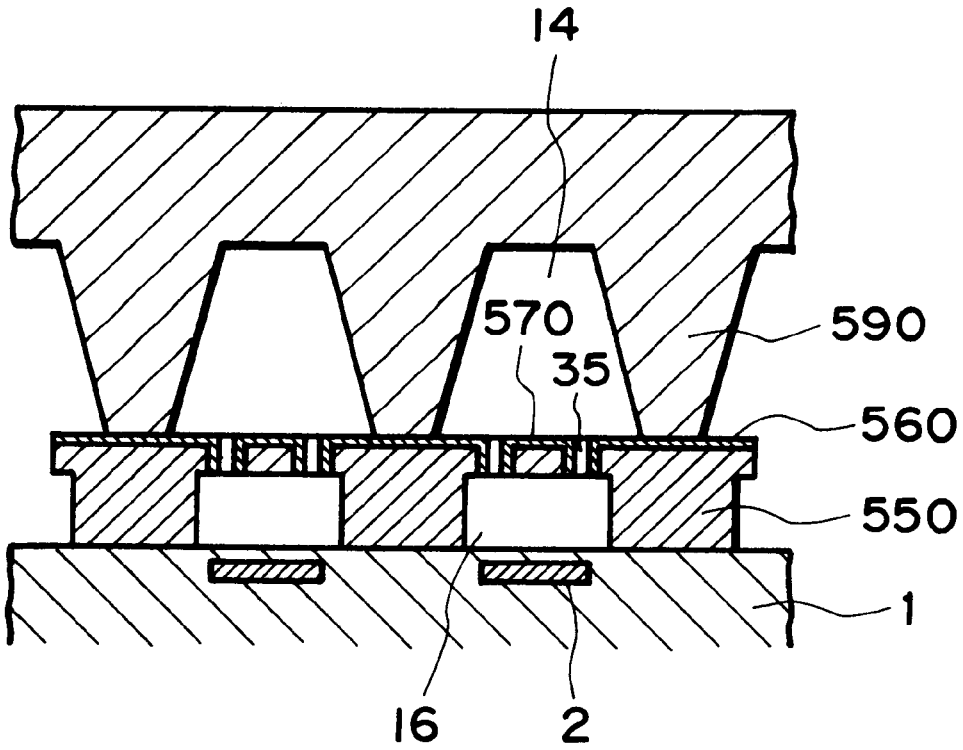
FIG. 33 is a sectional view of an ink jet recording head in a step of FIG. 32, as seen from the ejection outlet side.

FIG. 33 is a sectional view of an ink jet recording head.

In this example, as seen from the ejection outlet side. The nickel plate 5 50, water repelling material 5 60 and movable member 5 70 correspond to 370, 380 and 31 of FIG. 29, respectively. The flow passage wall 5 90 corresponds to the flow passage wall 22 of FIG. 27, (a). By applying the water repelling material 560 also on the side surface of the slit portion 35 for the movable member formation, the slit width can be further reduced to permit the meniscus to be maintained.

Therefore, the entering of the ejection ink into the bubble generation liquid chamber, can be further effectively prevented. Additionally, the refilling of the bubble generation liquid is easy so that the ejection is stabilized at all times.

Sixth Embodiment of Manufacturing Method

In this embodiment, ink jet recording head of the seventh embodiment is used, and the separation wall provided with the movable member is formed by two members having different liquid-repellencies. In this example, polysulfone and nickel were used as two members having different contact angles relative to water. The contact angles of the polysulfone and nickel relative to water are 70 degrees and 0 degrees, respectively. The polysulfone and nickel are used for the ejection ink side and for bubble generation liquid side, respectively.

FIG. 34 shows the steps. As shown in FIG. 30, (a)–(d), nickel electro-forming is effected two times, and then, the resist is removed, and the nickel plate is removed from the SUS substrate. Thus, an integral member 610 of bubble generation liquid flow path—separation wall is formed (FIG. 34, (a)). A thin film of polysulfone 620 is laminated on the separation wall portion, and a laser beam is projected onto the nickel side (FIG. 34, (b)). The nickel functions as a mask against the laser beam, and the polysulfone 620 is machined by the laser beam to form a slit 35 to provide a separation wall 640 comprising two members having movable member portion 630. The separation wall 640 thus provided is disposed and fixed on the heater board 1 having the heaters 2 so that the movable members 3130 are aligned with heaters 2.

In this step, the thin film of polysulfone 620 is laminated on the nickel plate 610, and the laser machining is carried out with the nickel plate 610 used as the laser mask, and therefore, the alignment between the two members is not necessary, so that the coupling therebetween is easy. Furthermore, since the nickel plate 610 is used as the laser mask as it is, no additional laser mask for the polysulfone machining is required, and the laser machining is correctly performed.

In this example, polysulfone and nickel are used as two members having different liquid-repellencies, but the materials are not inevitable, and any are usable if they have anti-solvent property and proper for functioning as the movable member. Manufacturing steps are not limiting, and etching, electro-forming, laser machining and so on, are usable alone or in combination.

The method of coupling the two members is not limited to the described above, and bonding, welding, ultrasonic welding or the like is usable.

FIG. 34, (d) is a sectional view of an ink jet recording head in this example, as seen from the ejection outlet side.

In the Figure, the separation wall 640, movable member 630 and polysulfone 620 correspond to 370, 360 and 380 in FIG. 29. Designated by 66 corresponds to the flow passage wall 15 in FIG. 27, (a). In this case, the contact angle of nickel relative to water is 0 degrees which means it is very easy to wet, and by applying the water repelling material (polysulfone), the contact angle is increased to 70 degrees so that the meniscus is maintained in the slit portion 35.

Thus, the entering of the ejection ink into the bubble generation liquid chamber can be prevented effectively in the slit portion for movable member formation. Additionally, the liquid-repellency is low in the bubble generation liquid chamber, and therefore, the refilling of the bubble generation liquid is easy so that the ejection is stabilized.

In this structure, the contact angle is large at the ejection ink side, and therefore, the meniscus is maintained in the slit portion 35, so that the entering of the ejection ink into the bubble generation liquid chamber can be prevented. The surface in the bubble generation liquid side has a small contact angle, and therefore, the refilling of the bubble generation liquid is easy, so that the ejection is always stable.

Seventh Embodiment of Manufacturing Method

Figure 35:
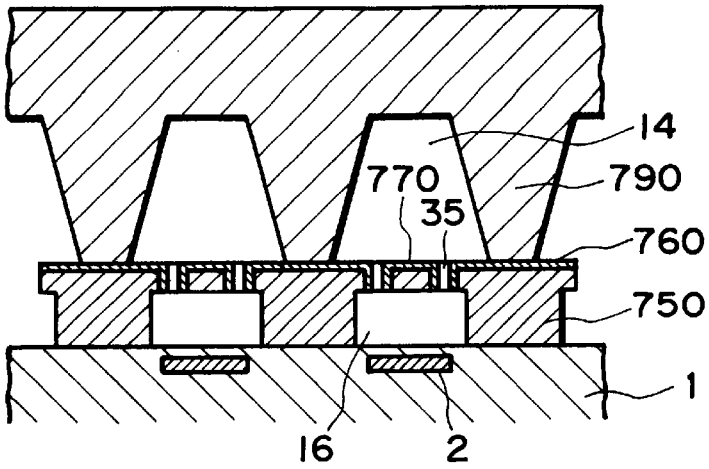
FIG. 35 is a sectional view of an ink jet recording head manufactured through another steps, as seen from the ejection outlet.

Referring to FIG. 35, the description will be made as to an ink jet recording head according to a seventh embodiment of the manufacturing method of the present invention. In the ink jet recording head of the previous embodiment, a first region (ejection ink) of the separation wall provided with the movable member, is plated with a material having a higher liquid-repellency than that of the separation wall. On the heater board 1 having heaters 2, a separation wall 750 for partitioning the first region containing the ejection ink (first liquid flow path 14) and the second region containing the bubble generation liquid (second liquid flow path 16) and having the movable member, is formed as a nickel plate 750 by electro-forming, through the steps as in FIG. 32, (a) (b) and (d) (the water repelling material application process of (c) is not performed). Then, the ejection ink side and a side of the slit portion are coated with gold 760 having a liquid repellency which is higher than that of the nickel (FIG. 35) (the contact angle of the nickel to the water is 0 degree, and that of the gold is 85 degrees). An orifice plate having the first liquid flow paths 14 is mounted thereto. Designated by 790 is flow passage walls. The movable member 770 are formed by slit portions 35.

The separation wall is formed through electro-forming using nickel, but this is not inevitable, and any is usable if it has an anti-solvent property and is capable of functioning as movable member. For example, it may be of metal, plastic resin material or the like alone or in combination. In addition, electro-forming, etching, laser machining or the like is usable.

The material to be plated is not limited to the above, and any material is selectable in consideration of the material of the separation wall, if it has a liquid repellency higher than that of the material of the separation wall, and has an anti-solvent property.

With this structure, the liquid repellency is high in the ejection ink side, and therefore, the meniscus is maintained, so that the ejection ink is prevented from entering the bubble generation liquid chamber. Since the liquid repellency is low in the bubble generation liquid side, the refilling of the bubble generation liquid is easy to occur, so that the ejection is stable.

Eighth Embodiment of Manufacturing Method

Figure 36:
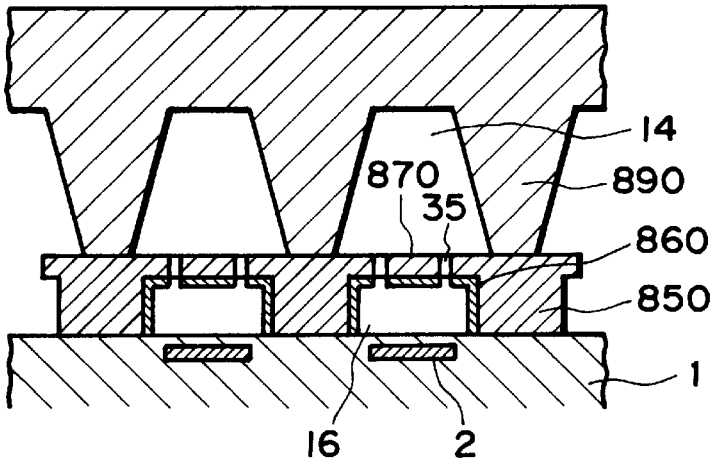
FIG. 36 is a sectional view of an ink jet recording head manufactured through a further step, as seen from the ejection outlet.

Referring to FIG. 36, the description will be made as to an ink jet recording head according to an eighth embodiment of the manufacturing method of the present invention. In the ink jet recording head of the above-described embodiment, the second region (bubble generation liquid) side of the separation wall provided with the movable member is plated with a material (gold) 760 which has a lower liquid repellency than the separation wall (nickel plate) 750. In the present embodiment, the separation wall 850 is manufactured by laser machining of the polysulfone through the process similar to FIG. 34, (a)–(c) of the previous embodiment, and it is placed on the heater board 1 having the heater 2, as shown in FIG. 36. The bubble generation liquid side is plated with nickel 860 having a lower liquid-repellency than the polysulfone (the contact angle of the polysulfone relative to water is 70 degrees and that of the nickel is 0 degrees). An orifice plate having the first liquid flow paths 14 is mounted thereto. Designated by 8 90 is flow passage walls.

The separation wall 850 was formation by laser machining of polysulfone, but this is not inevitable, and any material such as metal, plastic resin material are usable alone or in combination if it has an anti-solvent property and can function as the movable member. In addition, electro-forming, etching, laser machining or the like is usable. The material to be plated is not limited to the above, and any material is selectable in consideration of the material of the separation wall, if it has a liquid repellency lower than that of the material of the separation wall, and has an anti-solvent property.

With this structure, the ejection ink can be prevented form entering the bubble generation liquid chamber. The refilling of the bubble generation liquid is easy, so that the ejection is stabilized.

Ninth Embodiment of Manufacturing Method

Figure 37:
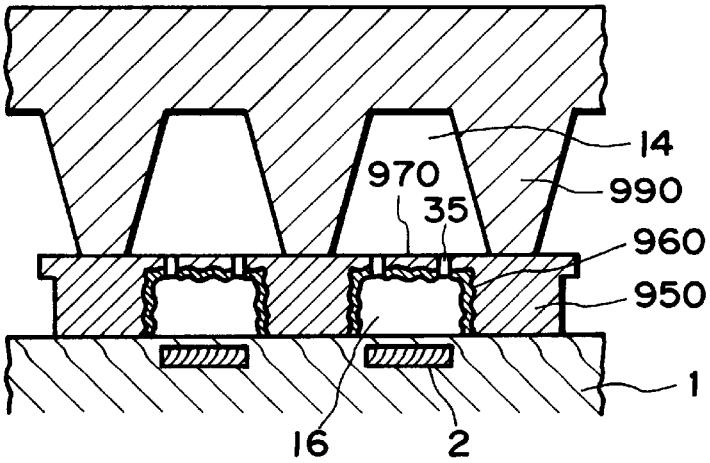
FIG. 37 is a sectional view of an ink jet recording head manufactured through a further step, as seen from the ejection outlet.

Referring to FIG. 37, the description will be made as to an ink jet recording head according to a ninth embodiment of the manufacturing method of the present invention. In this embodiment, the second region (bubble generation liquid) side of the separation wall provided with the movable member surface, is roughened, in the ink jet recording head according to the foregoing embodiments. In this example, the bubble generation liquid side surface of the separation wall 950 of polysulfone, is roughened by laser into a coarse surface 960 so as to provide a decreased liquid-repellency. The thus manufactured separation wall 950 is disposed on the heater board 1 having the heater 2, as shown in FIG. 37, and an orifice plate having a first liquid flow path 14 is mounted thereto. Designated by 990 are flow passage wall.

By roughening the surface, the refilling of the liquid is made easier by the function of the capillary force. The separation wall is of polysulfone, but the material is not limiting, and the other materials such as metal and plastic resin material are usable alone or in combination if it has an anti-solvent property and is capable of functioning as the movable member. The forming method is not limited to the above-described, and electro-forming, etching, laser machining or the like is usable.

With this structure, the refilling of the bubble generation liquid is easy, and the ejection is stabilized.

The description will be made as to a liquid ejecting head, head cartridge and liquid ejecting apparatus, wherein the liquid flow passage structure and separation wall described above are used.

Figure 38:
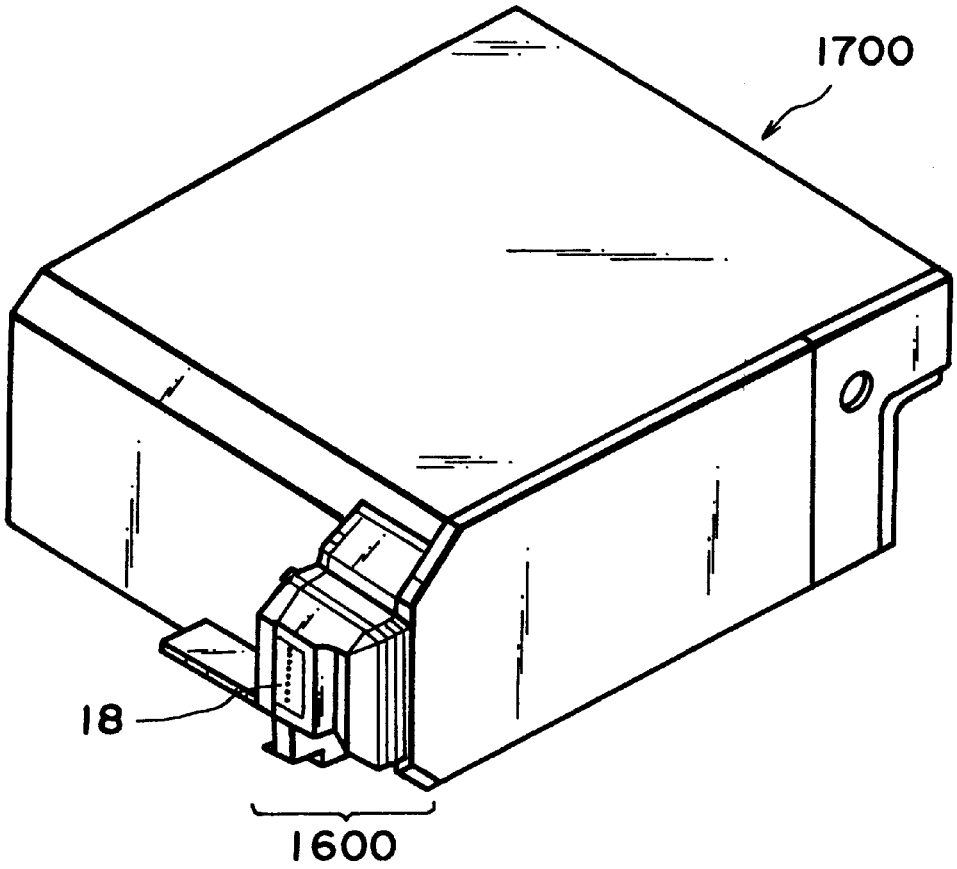
FIG. 38 is a perspective view of a head cartridge of the present invention.

FIG. 38 is an illustration of a head cartridge 1700 having a liquid ejecting head 1600 shown in FIG. 27, and an ink container for containing the liquid (two liquid materials if the bubble generation liquid and the ejection liquid are different) to be supplied to the liquid ejecting head 1600. The ink container is reusable by ink refilling after the ink is used up therefrom.

Figure 39:
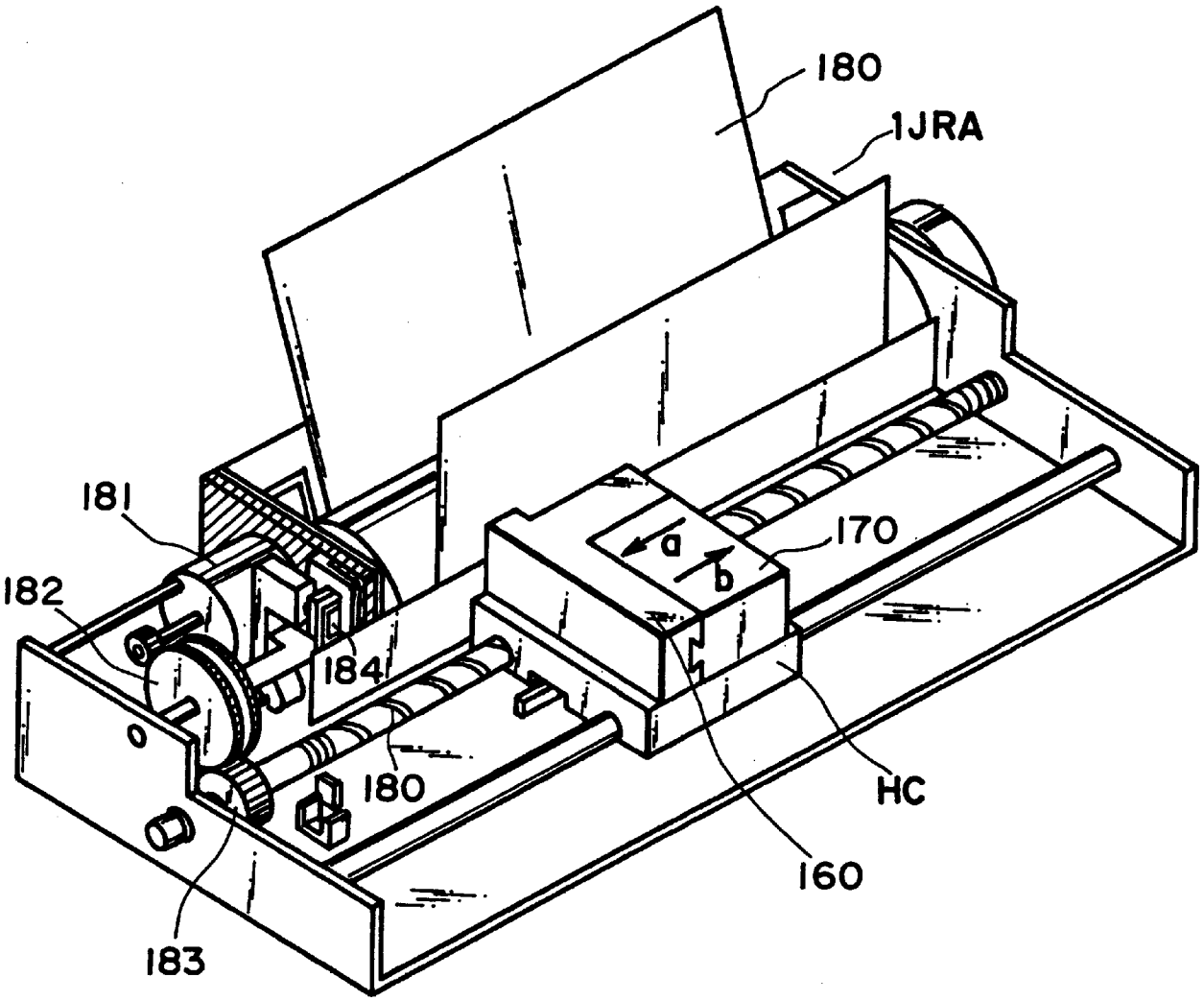
FIG. 39 is a schematic perspective view showing an example of a liquid ejecting apparatus of the present invention.

FIG. 39 is a schematic illustration of a liquid ejecting device used with the above-described liquid ejecting head. The carriage HC of the liquid ejecting apparatus in this example carries a head cartridge to which a liquid container portion 170 and a liquid ejecting head 160 are mountable, and is reciprocable in a direction of width of a recording material 1800 fed by recording material feeding means, namely, in the direction indicated by arrows a and b.

A driving signal is supplied to the liquid ejecting means on the carriage from unshown driving signal supply means, and in response to the signal, the recording material is ejected to the recording material from the liquid ejecting head.

The liquid ejecting apparatus of this embodiment comprises a motor 18 1 as a driving source for driving the recording material transporting means and the carriage, gears 18 2, 18 3 for transmitting the power from the driving source to the carriage, and carriage shaft 18 5 and so on. By the use of the recording device and the liquid ejecting method, satisfactory recording is possible on various kinds of recording material.

Figure 40:
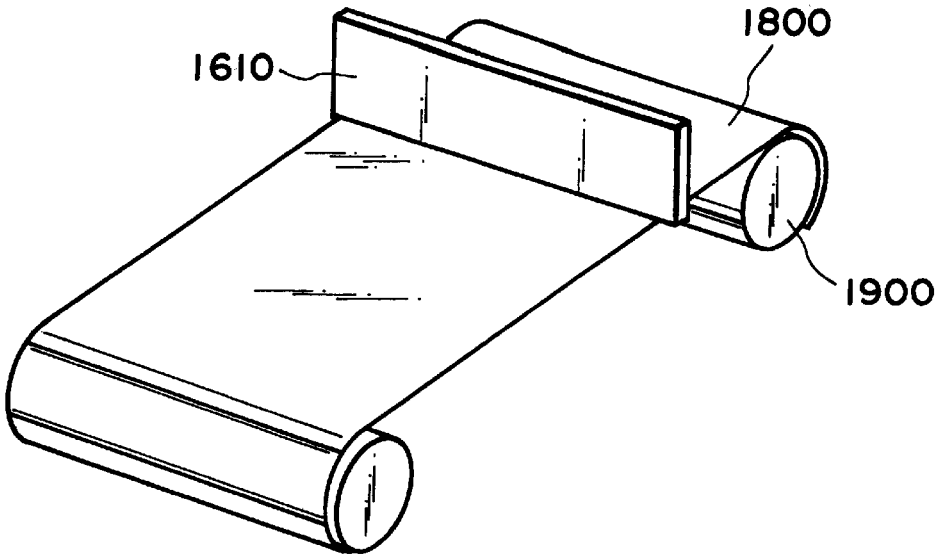
FIG. 40 is a schematic perspective view illustrating a full-line head of the present invention.

FIG. 40 is a schematic illustration of a so-called full-line head and device wherein a plurality of ejection outlets are arranged over the entire recordable width of the recording material 1800. In this Figure, 1610 designates the full-line head which is disposed opposed to the recording material 1800. Designated by 1900 is a feeding drum as the recording material feeding means.

In the foregoing descriptions of the embodiments of the present invention, by using ejection ink for the ejection liquid, the liquid ejecting head and the liquid ejecting apparatus are ink ejection recording head and ink ejection recording device.

As for the recording device, there are a printer for effecting recording on various paper materials, OHP sheet or the like, a recording device for plastic resin materials, for effecting recording on plastic resin materials such as that for a compact disk, a recording device for metal for effecting recording on a metal plate, a recording device for leather material for effecting recording on leather material, a recording device for wood material for effecting recording on wood material, a recording device for ceramic for effecting recording on ceramic material, a recording device for effecting recording on a three-dimensional net-like structure such as sponge or the like, and so on.

As for the ejection liquid usable with the liquid ejecting apparatus, it is selected properly by skilled in the art, in consideration of the recording material and the recording condition.

Figure 41:
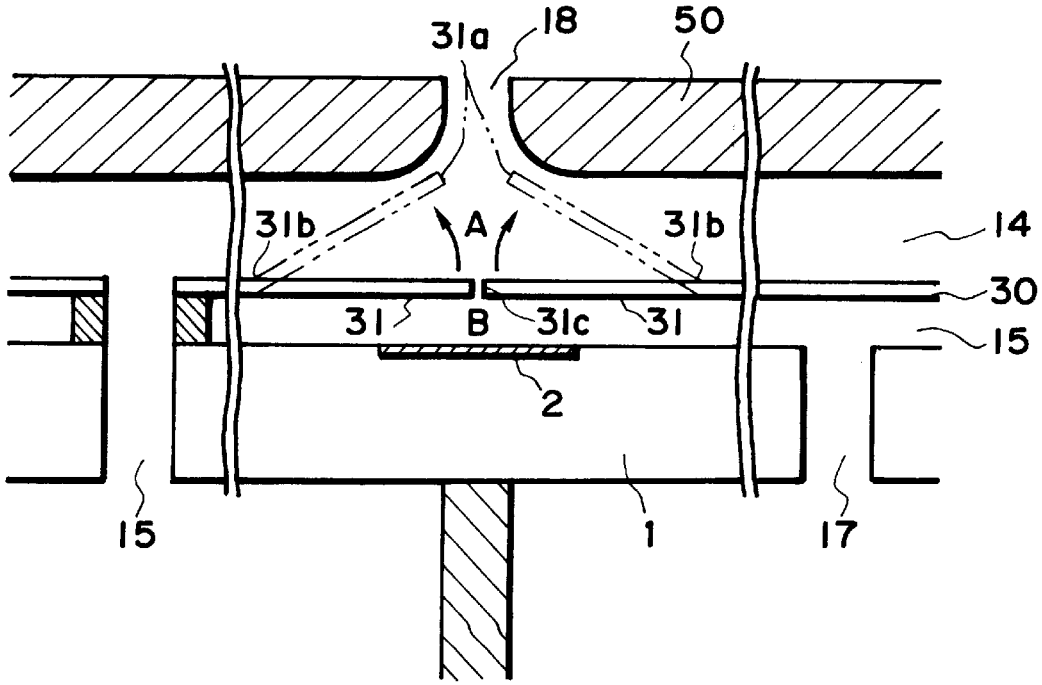
FIG. 41 is an illustration of a flow passage structure of a side shooter type head.

The present invention is not limited to a so-called edge shooter type head wherein an ejection outlet is provided at one end of the flow path extended along the surface of the heater, but it applicable to a so-called side shooter type head wherein the ejection outlet is provided opposed to the surface of the heater as shown in FIG. 41, for example.

In the side shooter type liquid ejecting head shown in FIG. 41, a substrate 1 is provided with a heat generating element 2 for generating thermal energy for generating a bubble in the liquid therein for each ejection outlet. Above the substrate 1, a second liquid flow path 16 for the bubble generation liquid is formed, and a first liquid flow path 14 for the ejection liquid is formed in direct fluid communication with the ejection outlet 18, the first liquid flow path 14 being formed in a grooved top plate 50. The first liquid flow path 14 is isolated from the second liquid flow path 16 by a separation wall 30 of elastic material such as metal. In these respects, this head is similar to the edge shooter type liquid ejecting head described hereinbefore.

The side shooter type liquid ejecting head is featured by the ejection outlet 18 provided right above the heat generating element 2, in the grooved top plate (orifice plate) 50 disposed above the first liquid flow path 14. In the separation wall 30, there is provided one pair of movable members 31 (double door type) at a portion between the ejection outlet 18 and the heat generating element 2. The both movable members 31 are of cantilever configuration supported by the fulcrum or base portions 31*b*. The free ends 31*a* thereof are disposed opposed to each other with a small space provided by the slit 31C right below the center portion of the ejection outlet 18. At the time of ejection, the movable portions 31, as indicated by arrows in FIG. 41, are opened to the first liquid flow path 14 by bubble generation of the bubble generation liquid in the bubble generating region B, and are closed by contraction of the bubble generation liquid. To the region A, the ejection liquid is refilled from the ejection liquid container which will be described hereinafter, and is prepared for the next bubble generation.

The first liquid flow path 14 and other first liquid flow paths are in fluid communication with an unshown container for retaining the ejection liquid through a first common liquid chamber 15, and the second liquid flow path 16 and other second liquid flow paths are in fluid communication with a container (unshown) for retaining the bubble generation liquid through a second common liquid chamber 17.

In the side shooter type liquid ejecting head having such a structure, the present invention is capable of providing the advantageous effects that the refilling of the ejection liquid is improved, and the liquid can be ejected with high ejection pressure and with high ejection energy use efficiency.

With respect to the manufacturing methods, they are substantially the same as with the edge shooter type heads, except that the positions of the ejection outlets in the top plate are different and that the positions and the structures of the common liquid chambers 15 17 are different. The relation between the separation wall 30 having the movable member and the flow passage wall constituting the second liquid flow path 16, is the same.

Head Cartridge Structure

Figure 42:
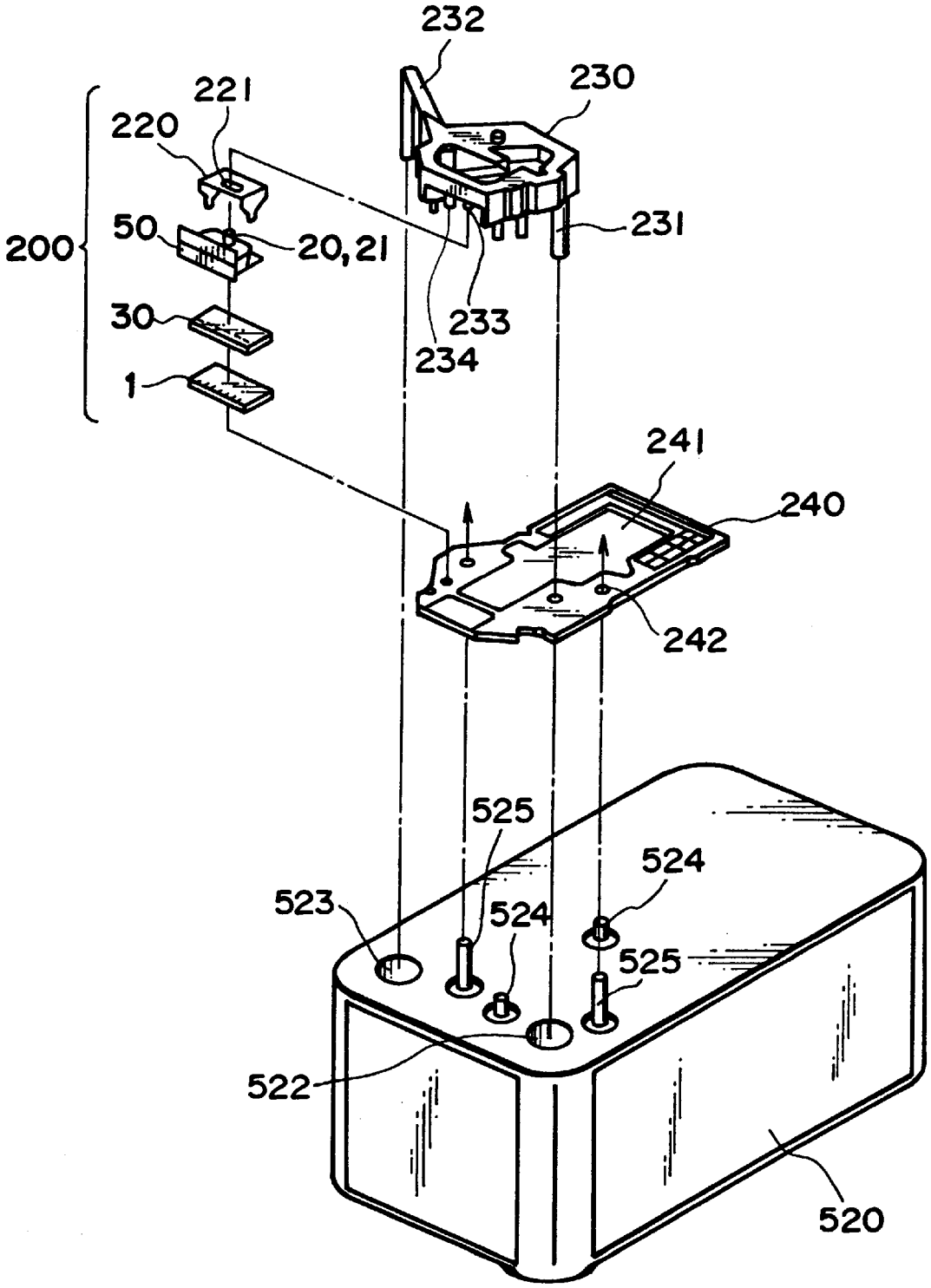
FIG. 42 is a schematic exploded perspective view according to an embodiment of a liquid ejection head cartridge.

The liquid ejection head cartridge having the liquid ejecting head of the present invention will be described. FIG. 42 is a schematic exploded perspective view of a liquid ejection head cartridge, wherein the liquid ejection head cartridge comprises a liquid ejecting head portion 200 and liquid container 520.

The liquid ejecting head portion 200 comprises an element substrate 1, a separation wall 30, a grooved member 50, a confining spring 70, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 220 functions to urge the grooved member 50 to the element substrate 1, and is effective to properly integrate the element substrate 1, separation wall 30, grooved and the supporting member 240 which will be described hereinafter.

Supporting member 240 functions to support an element substrate 1 or the like, and the supporting member 240 has thereon a circuit board 241, connected to the element substrate 1, for supplying the electric signal thereto, and contact pads 242 for electric signal transfer between the device side when the cartridge is mounted on the apparatus.

The liquid container 520 contains the ejection liquid such as ink to be supplied to the liquid ejecting head and the bubble generation liquid for bubble generation, separately. The outside of the liquid container 520 is provided with a positioning portion 524 for mounting a connecting member for connecting the liquid ejecting head with the liquid container and a fixed shaft 525 for fixing the connection portion. The ejection liquid is supplied to the ejection liquid supply passage 522 of a liquid supply member 231 through a supply passage 232 of the connecting member from the ejection liquid supply passage 522 of the liquid container, and is supplied to a first common liquid chamber through the ejection liquid supply passage 232, supply and 221 of the members. The bubble generation liquid is similarly supplied to the bubble generation liquid supply passage 232 of the liquid supply member 80 through the supply passage of the connecting member from the supply passage 523 of the liquid container, and is supplied to the second liquid chamber through the bubble generation liquid supply passage 233, 221, 212 of the members.

In such a liquid ejection head cartridge, even if the bubble generation liquid and the ejection liquid are different liquids, the liquids are supplied in good order. In the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

Figure 43:
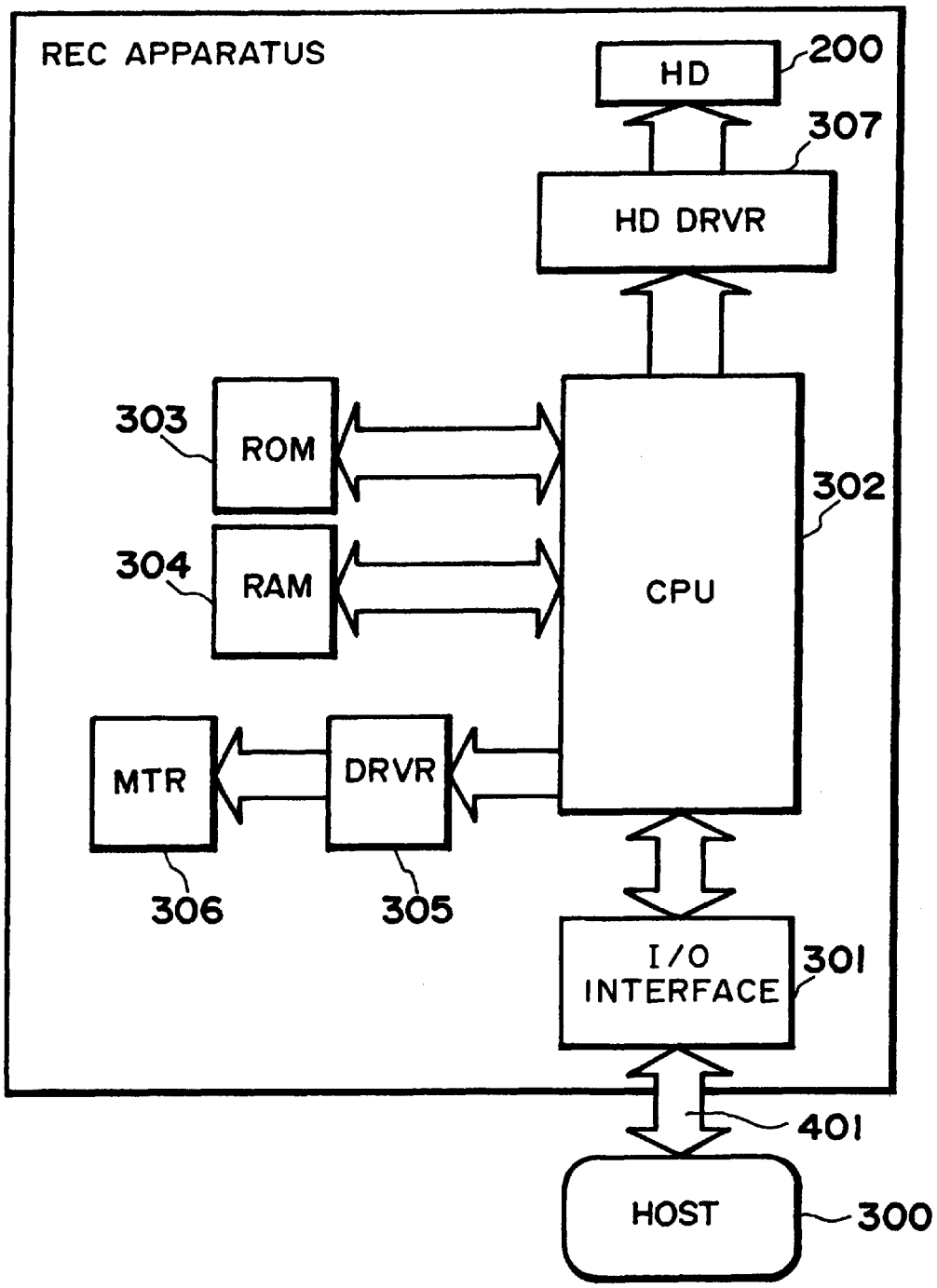
FIG. 43 is a block diagram showing a control mechanism of a liquid ejecting apparatus of the present invention.

FIG. 43 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

Recording System

Next, an exemplary ink jet recording system will be described, which records images on recording medium, using, as the recording head, the liquid ejection head in accordance with the present invention.

Figure 44:
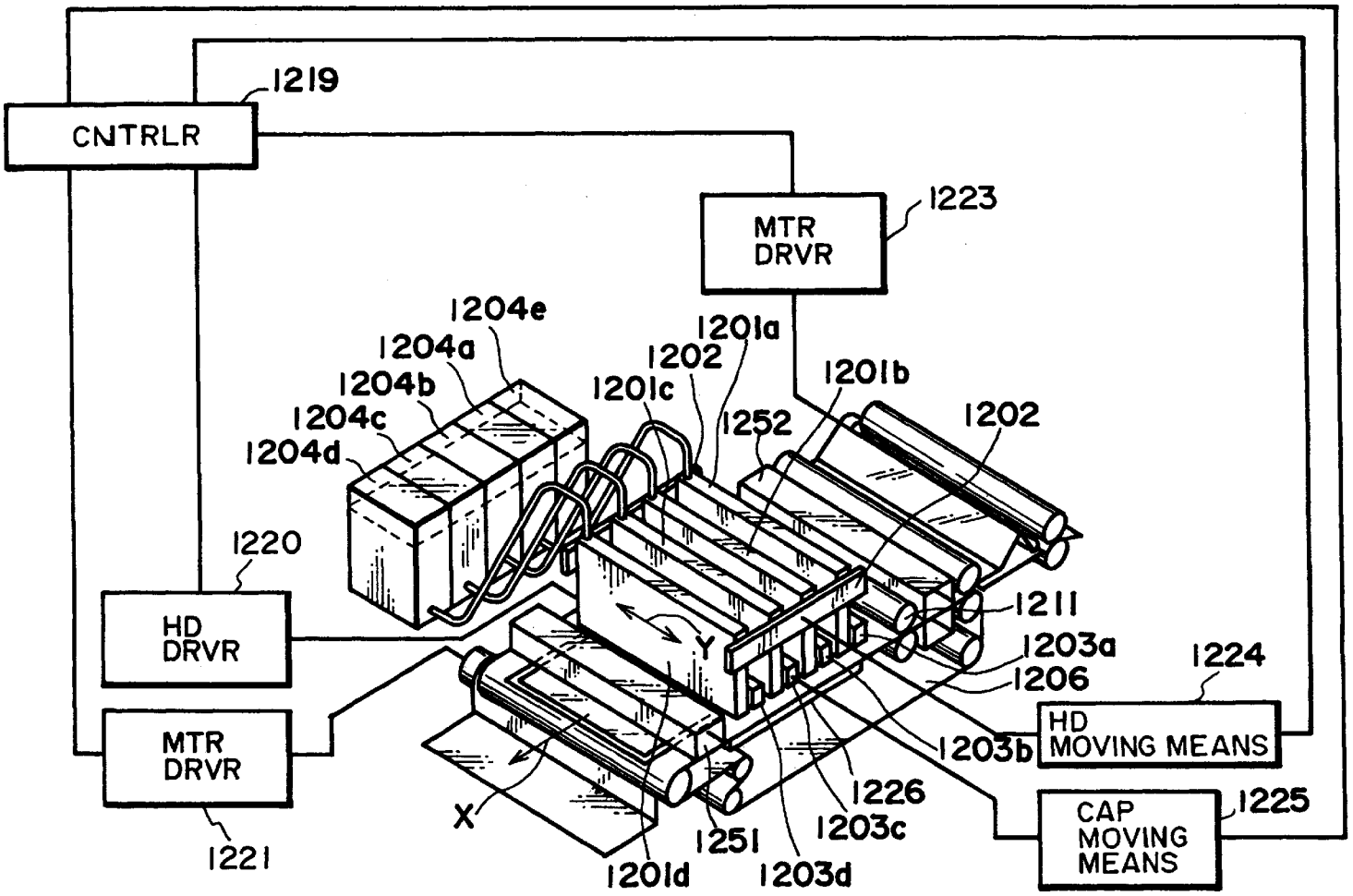
FIG. 44 is a schematic perspective view showing an example of an ink jet recording system for effecting recording using an embodiment of a liquid ejecting apparatus.

FIG. 44 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 1204*a*, 1204*b*, 1205*c* or 1204*d*. A reference numeral 1204*e* designates a bubble generation liquid container from which the bubble generation liquid is delivered to each head.

Below each head, a head cap 1203*a*, 1203*b*, 1203*c* or 1203*d* is disposed, which contains an ink absorbing member composed of sponge or the like. They cover the ejection orifices of the corresponding heads, protecting the heads, and also maintaining the head performance, during a non-recording period.

A reference numeral 1206 designates a conveyer belt, which constitutes means for conveying the various recording medium such as those described in the preceding embodiments. The conveyer belt 206 is routed through a predetermined path by various rollers, and is driven by a driver roller connected to a motor driver 1305.

The ink jet recording system in this embodiment comprises a pre-printing processing apparatus 1251 and a post-printing processing apparatus 1252, which are disposed on the upstream and downstream sides, respectively, of the ink jet recording apparatus, along the recording medium conveyance path. These processing apparatuses 1251 and 1252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultraviolet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

The embodiment provides an efficient structure for displacing the movable member in accordance with the pressure at the time of bubble generation. However, the movable member may be moved by another means for slightly displacing the movable member, or it may be first moved by this means, and then moved by the pressure wave upon the bubble generation. Said another moving means may have a bimetal structure or another.

According to an aspect of the embodiment, the bubble generation and the returning displacement of the movable member can be used with synergistic effect, so that the liquid adjacent the ejection outlet can be ejected at high-speed speed with high directivity, and therefore, the refilling frequency can be made higher than in a conventional bubble jet type ejecting method, head or the like, and the shot accuracy on the recording material is improved, thus improving the image quality.

In another aspect, the displacement start of the free end of the movable member occurs before the bubble contacts the movable member. This is accomplished by properly selecting the elasticity coefficient of the movable member, the pressure transmission properties of the bubble generation liquid and the ejection liquid, the driving condition for the bubble formation, each liquid passage structure or the like. More particularly, this can be accomplished more easily if the elastic deformation is easier, pressure propagation is quicker, a bubble growing speed is higher, and the flow resistance against the movable member is smaller. The pressure wave produced by the bubble generation is directed toward the ejection outlet, so that the following growth of the bubble is permitted with high efficiency and certainty toward the ejection outlet side.

In an aspect, the movable member is first brought into substantial contact to the growing bubble when the movable member is moving downwardly, and in this case, it is preferable that the elasticity coefficient of the movable member is large. According to this aspect of the present invention, the growth of the bubble is further assured toward the ejection outlet. Therefore, the combination is further desirable.

According to a further aspect of the present invention, the ejection ink is prevented from flowing toward the bubble generation liquid chamber, and the refilling of the bubble generation liquid is made easier to accomplish stabilized recording, by the liquid-repellency of separation wall at the ejection ink side higher that at the bubble generation liquid side.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting method using a liquid ejection head having a movable member disposed faced to a bubble generating region having a bubble generating means for generating a bubble, the bubble generating region being disposed between side walls, and having a free end at a downstream side thereof with respect to a flow direction of liquid, wherein the free end of the movable member is displaced by a pressure generated by the bubble generated by said bubble generating means in said bubble generating region, and the pressure is directed toward an ejection outlet by the movable member to eject the liquid through the ejection outlet, comprising the steps of:

generating a bubble in said bubble generating region by activating said bubble generating means;

moving said movable member in a direction away from said bubble generating means by the pressure generated by said bubble generating means;

contacting the bubble to said movable member after said moving step; and reducing the bubble and returning the movable member toward said bubble generating means.

2. A method according to claim 1, wherein said movable member is first substantially contacted to the bubble which is expanding or being guided toward the ejection outlet, while said movable member is returning toward its home position.

3. A method according to claim 1, wherein said movable member has different liquid repellencies at a side faced to said bubble generating region and at the other side.

4. A method according to claim 1, wherein said bubble is generated by film boiling phenomenon caused by applying heat generated by a heating element to the liquid.

5. A liquid ejecting method using a liquid ejection head having a first liquid flow path in fluid communication with an ejection outlet, and a second liquid flow path disposed adjacent the first liquid flow path and having a bubble generating region, a movable member having a free end adjacent the ejection outlet and disposed between said first liquid flow path and said bubble generating region of said second liquid flow path, and a bubble generating means for generating a bubble disposed in said bubble generating region, the bubble generating region being disposed between side walls, and the free end of the movable member is displaced into said first liquid flow path by a pressure generated by the bubble generated by said bubble generating means to eject the liquid through the ejection outlet, comprising the steps of:

generating a bubble in said bubble generating region by activating said bubble generating means;

moving said movable member in a direction away from said bubble generating means by the pressure generated by said bubble generating means;

contacting the bubble to said movable member after said moving step; and reducing the bubble and returning the movable member toward said bubble generating means.

6. A method according to claim 5, wherein said movable member is first substantially contacted to the bubble which is expanding or being guided toward the ejection outlet, while said movable member is returning toward its home position.

7. A method according to claim 5, wherein said movable member has different liquid repellencies at a side faced to said bubble generating region and at the other side.

8. A liquid ejecting method using a liquid ejection head having a movable member disposed faced to a bubble generating region and having a free end at a downstream side thereof with respect to a flow direction of liquid, wherein the free end of the movable member is displaced by a pressure generated by a bubble in said bubble generating region, and the pressure is directed toward an ejection outlet by the movable member to eject the liquid through the ejection outlet, comprising the steps of:

generating a bubble in said bubble generating region by activating a bubble generating means;

moving said movable member in a direction away from said bubble generating means by pressure generated by said bubble generating means;

contacting the bubble to said movable member after said moving step; and reducing the bubble and returning the movable member toward said bubble generating means, wherein said movable member is first substantially contacted to the expanding bubble which is being guided toward the ejection outlet while said movable member is returning toward said bubble generating means.

9. A method according to claim 8, wherein said movable member has different liquid repellencies at a side faced to said bubble generating region and at the other side.

10. A liquid ejecting method using a liquid ejection head having a first liquid flow path in fluid communication with an ejection outlet, and a second liquid flow path disposed adjacent the first liquid flow path and having a bubble generating region, and a movable member having a free end adjacent the ejection outlet and disposed between said first liquid flow path and said bubble generating region of said second liquid flow path, wherein a bubble is generated in said bubble generating region, and the free end of the movable member is displaced into said first liquid flow path by a pressure generated by the bubble to eject the liquid through the ejection outlet, comprising the steps of:

generating a bubble in said bubble generating region by activating a bubble generating means;

moving said movable member in a direction away from said bubble generating means by pressure generated by said bubble generating means;

contacting the bubble to said movable member after said moving step; and reducing the bubble and returning the movable member toward said bubble generating means;

wherein said movable member is first substantially contacted to the expanding bubble which is being guided toward the ejection outlet while said movable member is returning toward said bubble generating means.

11. A method according to claim 10, wherein the bubble generated in said bubble generating region expands into said first liquid flow path in accordance with displacement of liquid ejecting method.

12. A method according to claim 10, wherein said second liquid flow path contains liquid which is different from the liquid in said first liquid flow path and which is higher at least in the lowness of the viscosity, in the bubble generation property and in stabilization against heat.

13. A liquid ejecting head for ejecting liquid by generation of a bubble, comprising:

a first liquid flow path in fluid communication with an ejection outlet for ejecting the liquid;

a second liquid flow path having a heat generating element for generating a bubble in the liquid by applying heat to the liquid; and a separation wall disposed between said first liquid flow path and said second liquid flow path;

a movable member extending from said separation wall, said movable member having a fulcrum, which is disposed upstream of a bubble generating region, and a free end of the movable member is disposed downstream of an area center of said bubble generating region, said movable member also having the free end at a side closer to the ejection outlet, said free end being displaced to said first liquid flow path on the basis of a pressure generated by a bubble generated in said second liquid flow path to transmit the pressure to the first liquid flow path, and wherein the bubble is contacted to said movable member after said movable member is moved away from the bubble generating region.

14. An ejecting head according to claim 13, wherein a liquid-repellency is higher at the side faced to said first liquid flow path than at the other side.

15. An ejecting head according to claim 14, wherein said bubble is generated by film boiling phenomenon caused by applying heat generated by a heating element disposed in said second liquid flow path to the liquid.

16. An ejecting head according to claim 15, wherein said heating element is in the form of an electrothermal transducer for generating heat upon receipt of an electric signal.

17. An ejecting head according to claim 15, wherein said second liquid flow path having the heating element is in the form of a chamber.

18. An ejecting head according to claim 13, wherein the side faced to said first liquid flow path has a water repelling material layer.

19. An ejecting head according to claim 13, wherein said separation wall comprises two members having different liquid-repellencies.

20. An ejecting head according to claim 19, wherein said separation wall has a layer of a material having a liquid-repellency higher than that of the separation wall, at the side faced to said first liquid flow path.

21. An ejecting head according to claim 19, wherein said separation wall has a layer of a material having a liquid-repellency lower than that of the separation wall, at the side faced to said second liquid flow path.

22. An ejecting head according to claim 13, wherein said separation wall has a roughened surface at the side faced to second liquid flow path.

23. An ejecting head according to claim 13, wherein said movable member is of metal such as nickel, gold.

24. A head cartridge comprising:

a liquid ejecting head according to claim 13;

a liquid container for containing the liquid to be supplied to the liquid ejecting head; and liquid conveying means for conveying the liquid from the liquid container to the liquid ejecting head.

25. A head cartridge according to claim 24, wherein said ejecting head and said liquid container are separable from each other.

26. A head cartridge according to claim 25, wherein the liquid has been refilled into said container.

27. A liquid ejection apparatus comprising:

a liquid ejecting head according to claim 13; and driving signal supply means for supplying a driving signal to the liquid ejecting head to cause the liquid ejecting head to eject the liquid.

28. A liquid ejection apparatus according to claim 27, wherein the liquid which is ink is ejected onto a recording material selected from the group consisting of recording paper, textile, leather, plastic resin material, metal and wood.

29. A liquid ejection apparatus comprising:

a liquid ejecting head according to claim 13; and recording medium feeding means for feeding a recording material past said liquid ejecting head to receive the liquid ejected from said liquid ejecting head.

30. A print on a recording medium produced by the steps of:

providing a liquid ejection head having a movable member disposed faced to a bubble generating region having a bubble generating means for generating a bubble, the bubble generating region being disposed between side walls, and having a free end at a downstream side thereof with respect to a flow direction of liquid, wherein the free end of the movable member is displaced by a pressure generated by the bubble generated by said bubble generating means in said bubble generating region, and the pressure is directed toward an ejection outlet by the movable member to eject the liquid through the ejection outlet;

generating a bubble in said bubble generating region by activating said bubble generating means;

moving said movable member in a direction away from said bubble generating means by the pressure generated by said bubble generating means;

contacting the bubble to said movable member after said moving step; and then reducing the bubble and returning the movable member toward said bubble generating means.

* * * * *

UNITED STATES PATENT AND TRADEMARK OFFICE

CERTIFICATE OF CORRECTION

PATENT NO. : 6,206,508 B1
DATED : March 27, 2001
INVENTOR(S) : Yoshie Asakawa et al.

Figure 45A:
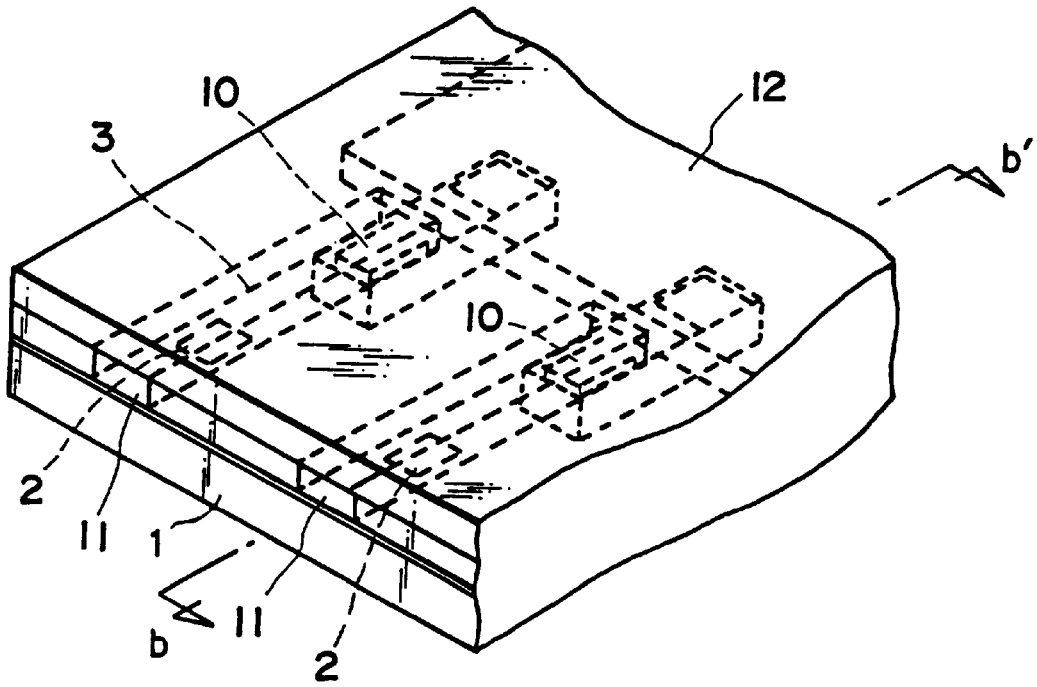
FIG. 45 is illustrations of a flow passage structure of a conventional head, wherein (*a*) is a perspective view, and (*b*) is a sectional view taken along a line b-b' line in (*a*).
Figure 45B:
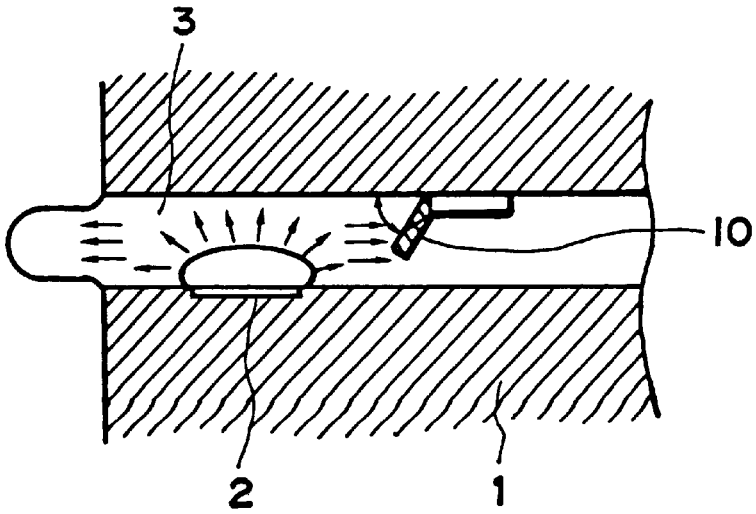

It is certified that error appears in the above-identified patent and that said Letters Patent is hereby corrected as shown below:

Column 2,
Line 9, "FIG. 45, (a), (b)." should read -- FIGS. 45(a) and 45(b). --;
Line 17, "FIG. 45, (a) and (b)." should read -- FIGS. 45(a) and 45(b). --;
Line 21, "FIG. 45, (b)," should read -- FIG. 45(b), --;
Line 22, "stick" should read -- sticks --;
Line 34, "make" should read -- made --;
Line 35, "FIG. 45, (a)." should read -- FIG. 45(a). --;
Line 46, "it" should be deleted.

Column 3,
Line 6, "some" should read -- same --.

Column 5,
Line 54, "electric" should read -- an electric --.

Column 7,
Line 2, "high-speed" should read -- a high --.

Column 8,
Line 29, "through" should read -- and --.

Figure 30A:
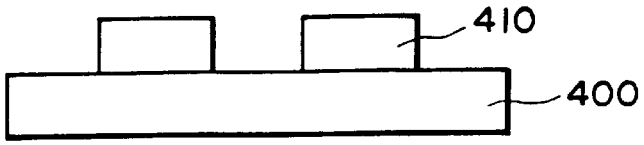
FIG. 30 is a schematic sectional view showing manufacturing steps for a separation wall formed by repeating electro-forming, the separation wall having different water repellencies at the sides thereof; In (*a*), portions for forming the bubble generation liquid flow path and the movable member are formed by resist; In (*b*), a nickel plate layer (plating) has been formed; In (*c*), resist is provided at a portion where a slit is to be formed; In (*d*), a second nickel plate (plating) is formed; In (*e*), water repelling material has been applied to an ejection liquid side of the nickel plate; and in (*f*), the resist has been removed, and the substrate and the nickel plate have been separated from each other.
Figure 30B:
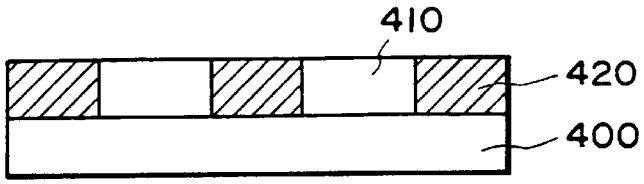
Figure 30C:
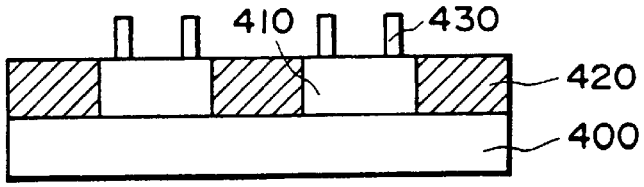
Figure 30D:
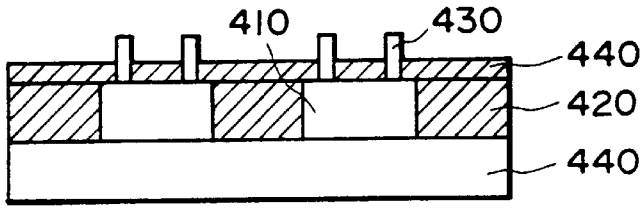
Figure 30E:
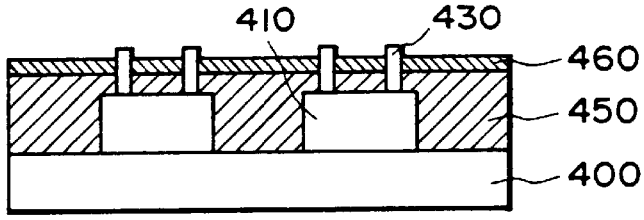
Figure 30F:
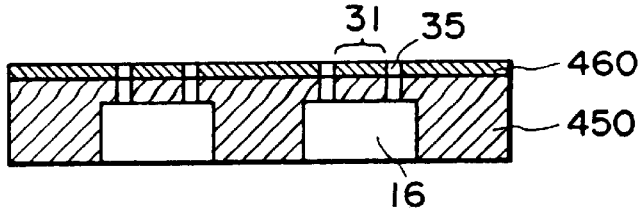

Column 9,
Line 15, "(a)," should read -- FIG. 30(a), --;
Line 17, "(b)," should read -- FIG. 30(b), --;
Line 18, "(c)," should read -- FIG. 30(c), --;
Line 19, "(d)," should read -- FIG. 30(d), --;
Line 20, "(e)," should read -- FIG. 30(e), --;
Line 22, "(f)," should read -- FIG. 30(f), --;
Line 28, "(a)," should read -- FIG. 32(a), --;
Line 30, "(b)," should read -- FIG. 32(b), --;
Line 31, "(c)," should read -- FIG. 32(c), --;
Line 32, "(d)," should read -- FIG. 32(d), --;
Line 37, "(a)," should read -- FIG. 34(a), --;
Line 39, "(b)," should read -- FIG. 34(b), --;
Line 40, "(c)," should read -- FIG. 34(c), --;
Line 41, "(d)," should read -- FIG. 34(d), --; and
Line 45, "steps," should read -- step, --.

UNITED STATES PATENT AND TRADEMARK OFFICE

CERTIFICATE OF CORRECTION

PATENT NO. : 6,206,508 B1
DATED : March 27, 2001
INVENTOR(S) : Yoshie Asakawa et al.

It is certified that error appears in the above-identified patent and that said Letters Patent is hereby corrected as shown below:

Column 10,
Line 4, "FIG. 45 is" should read -- FIGS, 45(a) and 45(b) are --;
Line 5, "(a)" should read -- FIG. 45(a) -- and "(b)" should read -- FIG. 45(b) --
Line 6 "(a)" should read -- FIG. 45(a) --;
Line 9, "EMBODIMENT" should read -- EMBODIMENTS --; and
Line 14, "election" should read -- ejection --.

Figure 1B:
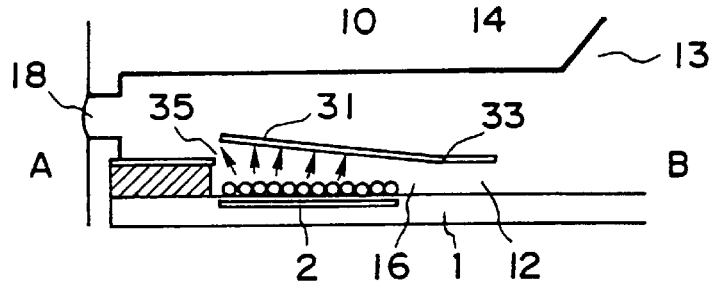
Figure 1C:
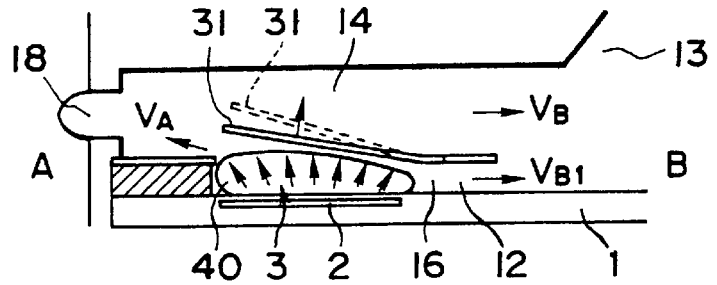

Column 11,
Line 8, "FIG. 1, (b) and (c)" should read -- FIGS. 1(b) and 1(c) --;
Line 34, "of the" should be deleted;
Line 40, "it" should read -- it is --;
Line 41, "election efficiency" should read -- ejection efficiency, --
and "election pressure" should read -- ejection pressure --; and
Line 66, "FIG. 1, (a)" should read -- FIG. 1(a) --.

Column 12,
Line 11, "FIG. 1, (b)" should read -- FIG. 1(b) --;
Line 14, "of of" should read -- of --;
Line 28,"FIG. 1, (c)" should read -- FIG. 1(c) --;
Line 46, "FIG. 1, (d)" should read -- FIG. 1(d) --;
Line 62, "FIG. 1, (e)" should read -- FIG. 1(e) --; and
Line 67, "FIG. 1, (a)" should read -- FIG. 1(a) --.

Figure 1D:
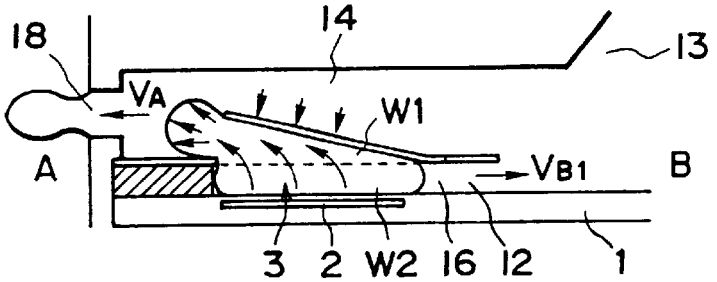
Figure 1E:
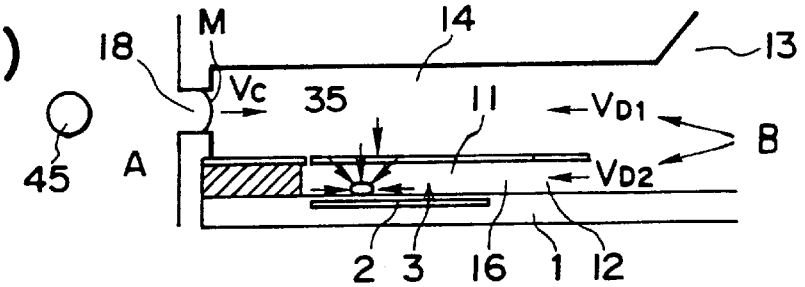
Figure 2:
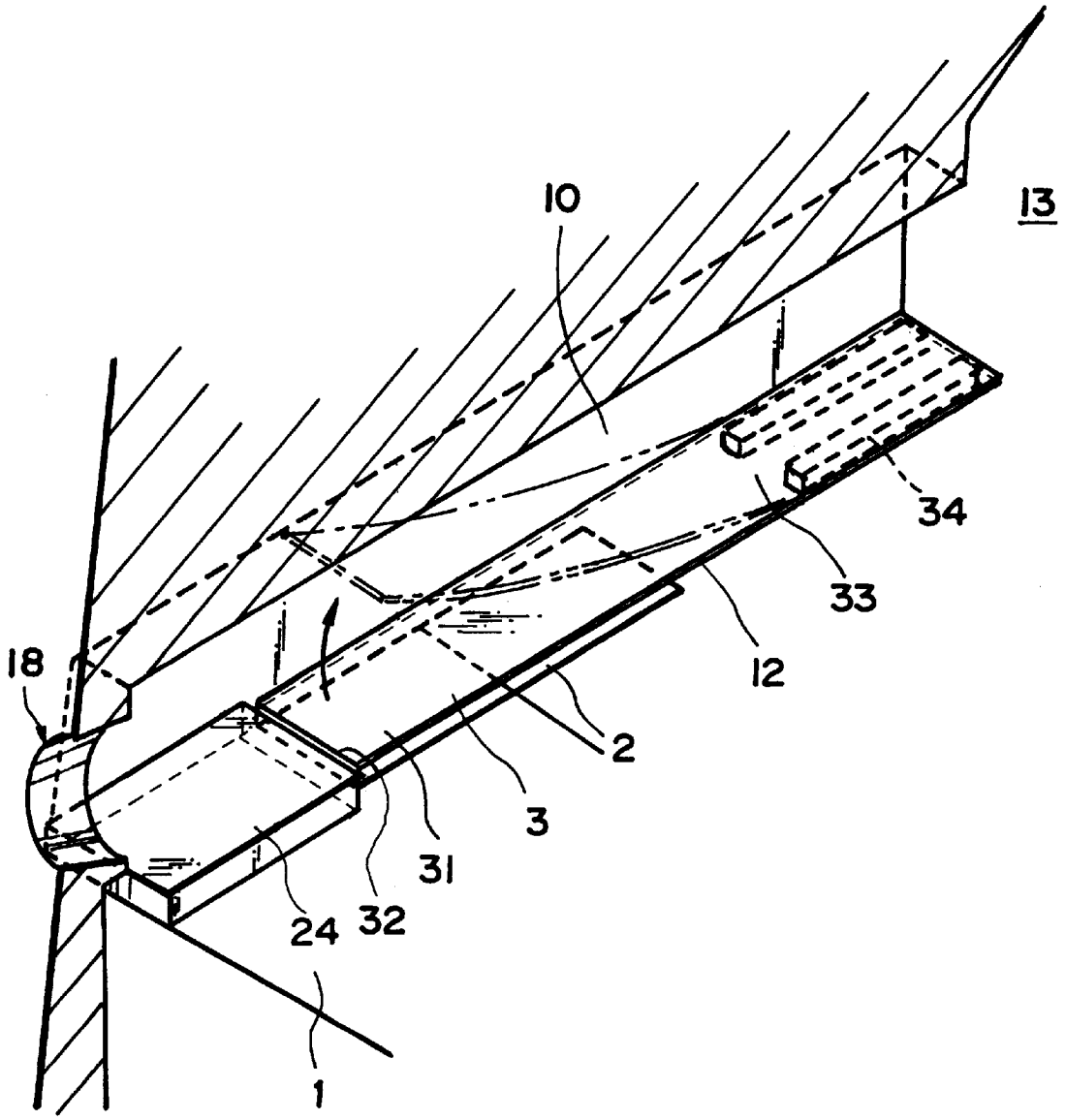
FIG. 2 is a partly broken perspective view of a liquid ejecting head according to an embodiment of the present invention.

Column 13,
Line 17, "(Figure, (d))," should read -- (FIG. 1(d)), --.

Column 15,
Line 27, "election" should read -- ejection --.

Column 16,
Line 23, "above described" should read -- above-described --.

Figure 9A:
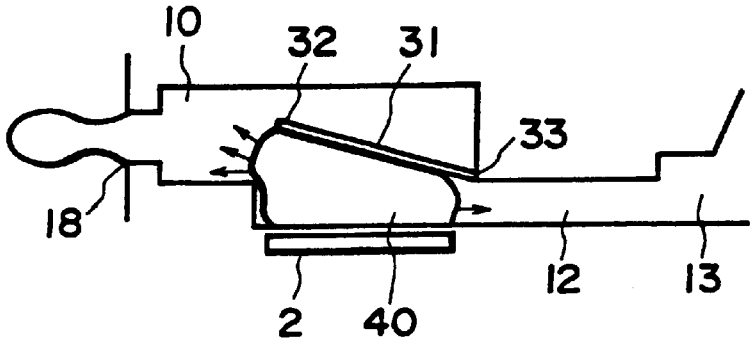
FIG. 9, consisting of FIGS. 9(*a*) through 9(*c*), is a schematic sectional view of a liquid ejecting head according to a fifth embodiment of the present invention.
Figure 9B:
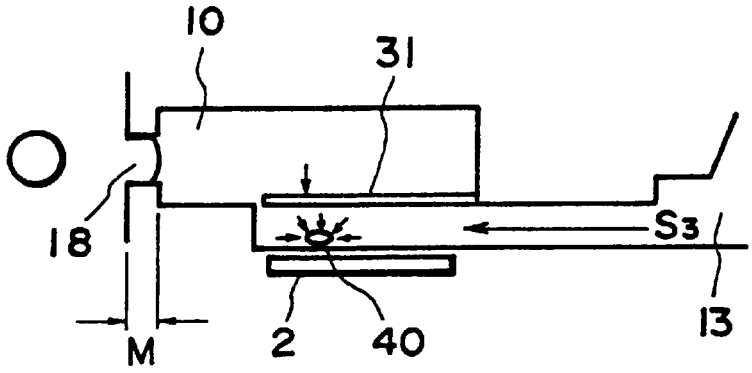
Figure 9C:
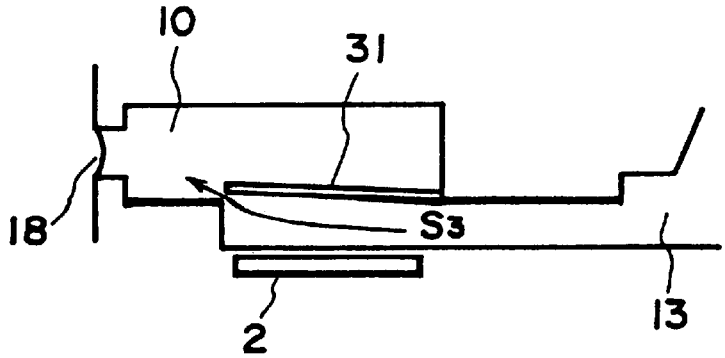

Column 17,
Line 43, "FIGS. 9, (a), (b) and (c)" should read -- FIGS. 9(a), 9(b) and 9(c) --;
Line 63, "FIG. 9, (a)" should read -- FIG. 9(a) --; and
Line 64, "FIG. 9, (b)" should read -- FIG. 9(b) --.

Column 18,
Line 1, "FIG. 9, (c)" should read -- FIG. 9(c) --.

UNITED STATES PATENT AND TRADEMARK OFFICE

CERTIFICATE OF CORRECTION

PATENT NO. : 6,206,508 B1
DATED : March 27, 2001
INVENTOR(S) : Yoshie Asakawa et al.

It is certified that error appears in the above-identified patent and that said Letters Patent is hereby corrected as shown below:

Column 19,
Line 14, "election" should read -- ejection --;
Line 16, "FIG. 12, (a)" should read -- FIG. 12(a) --;
Line 17, "FIG. 12, (b)" should read -- FIG. 12(b) --;
Line 27, "FIG. 12, (a)" should read -- FIG. 12(a) --; and
Line 51, "liquid" should read -- liquid is --.

Column 20,
Line 46, "(a)" should read -- 14(a) --;
Line 48, "(b)" should read -- 14(b) --; and
Line 49, "FIG. 14, (c)" should read -- FIG. 14(c) --.

Column 21,
Line 24, "FIG. 14, (c)," should read -- FIG. 14(c), --;
Line 57, "FIG. 15, (a)," should read -- FIG. 15(a), --;
Line 58, "(b)," should read -- FIG. 15(b), --;
Line 60, "(c)," should read -- FIG. 15(c), --; and
Line 63, "FIG. 14. (a)," should read -- 14(a), --.

Column 22,
Line 32, "compound" should read -- compounds --;
Line 33, "compound" should read -- compounds --;
Line 44, "compound" should read -- compounds --;
Line 45, "alloy" should read -- alloys --;
Line 46, "compound" should read -- compounds --; and
Line 52, "mixture" should read -- a mixture --.

Column 23,
Line 2, "fro" should read -- for --.

Column 24,
Line 13, "is" should read -- are --;
Line 16, "FIG. 17, (a)" should read -- FIG. 17(a) --;
Line 17, "FIG. 17, (b)" should read -- FIG. 17(b) --; and
Line 18, "area" should read -- areas --.

UNITED STATES PATENT AND TRADEMARK OFFICE

CERTIFICATE OF CORRECTION

PATENT NO. : 6,206,508 B1
DATED : March 27, 2001
INVENTOR(S) : Yoshie Asakawa et al.

It is certified that error appears in the above-identified patent and that said Letters Patent is hereby corrected as shown below:

Column 25,
Line 14, "FIG. 4," should read -- FIG. 4 --;
Line 57, "chamber," should read -- chambers, --; and
Line 58, "reduces" should read -- reduced --.

Column 26,
Line 5, "plurality" should read -- the plurality --; and
Line 31, "grooved" should read -- grooved member 50 --.

Column 27,
Line 66, "includes:" should read -- include: --.

Figure 24A:
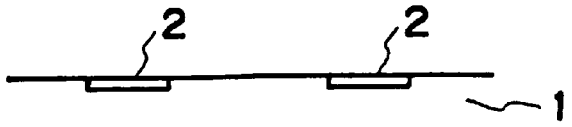
FIG. 24, consisting of FIGS. 24(*a*) through 24(*e*), is a process chart illustrating a manufacturing method of a liquid ejecting head according to the present invention.
Figure 24B:
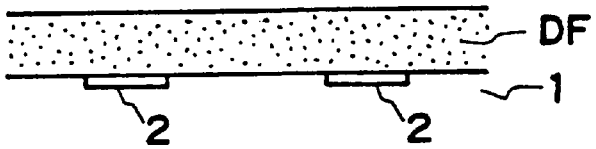
Figure 24C:
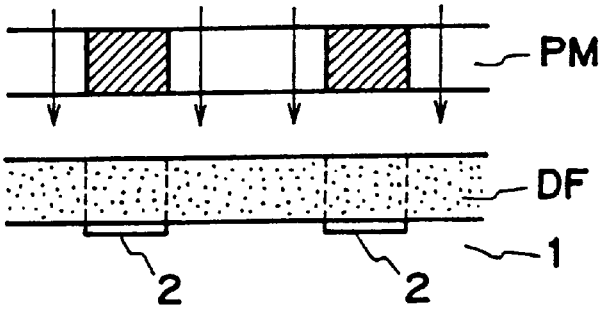
Figure 24D:
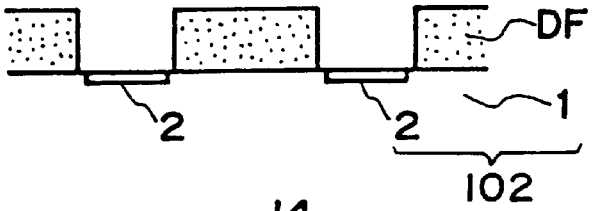
Figure 24E:
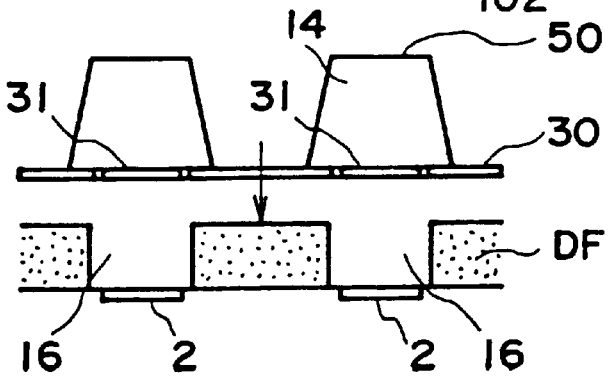

Column 29,
Line 49, "FIGS. 24, (a)-(e), is" should read -- FIGS. 24(a)-24(e) are --; and
Line 53, "FIG. 24, (a)," should read -- FIG. 24(a) --.

Column 30,
Line 2, "24, (b)," should read -- 24(b), --;
Line 6, "FIG. 24, (c)," should read -- FIG. 24(c) --;
Line 11, "from," should read -- from --;
Line 12, "KAISHA)," should read -- KAISHA, --;
Line 14,"FIG. 24, (d)" should read -- FIG. 24(d) --;
Line 24, "100 mJ/$cm_2$" should read -- 100 mJ/$cm^2$ --;
Line 38, "FIG. 24, (e)" should read -- FIG. 24(e) --; and
Line 60, "massproduction" should read -- mass production --.

Column 31,
Line 1, "FIGS. 25, (a)-(d), is" should read -- FIGS. 25(a)-25(d) are --;
Line 5, "FIG. 25, (a)," should read -- FIG. 25(a), --;
Line 8, "FIG. 25, (b)," should read -- FIG. 25(b) --;
Line 18, "FIG. 25, (c)," should read -- FIG. 25(c) --;
Line 33, "FIG. 25, (d)." should read -- FIG. 25(d). --;
Line 51, "FIGS. 25, (a)-(d), is" should read -- FIGS. 25(a)-25(d) are --;
Line 55, "FIG. 25, (a)," should read -- FIG. 25(a), --; and
Line 60, "(b)" should read -- FIG. 25(b) --.

UNITED STATES PATENT AND TRADEMARK OFFICE

CERTIFICATE OF CORRECTION

PATENT NO. : 6,206,508 B1
DATED : March 27, 2001
INVENTOR(S) : Yoshie Asakawa et al.

Figure 25A:
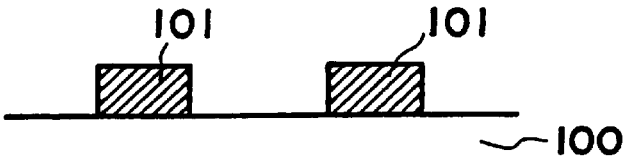
FIG. 25, consisting of FIGS. 25(*a*) through 25(*d*), is a process chart illustrating a manufacturing method of a liquid ejecting head according to another embodiment of the present invention.
Figure 25B:
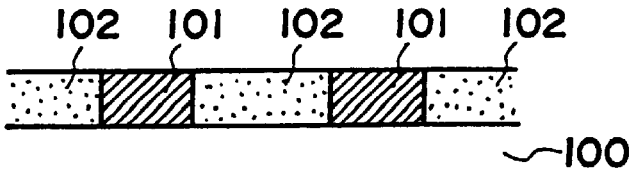
Figure 25C:
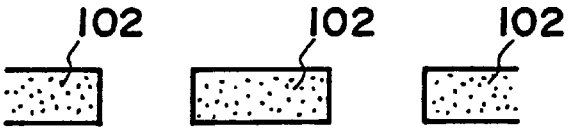
Figure 25D:
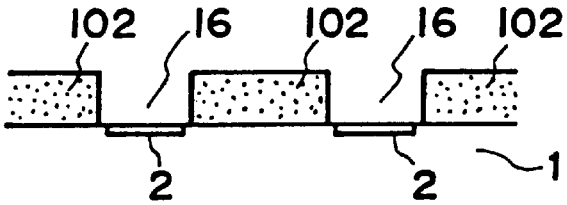
Figure 26A:
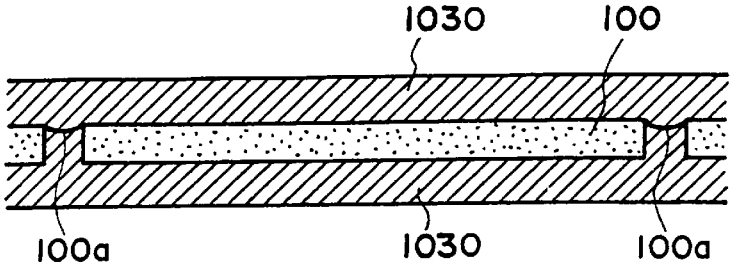
FIG. 26, consisting of FIGS. 26(*a*) through 26(*d*), is a process chart illustrating a manufacturing method of a liquid ejecting head according to a further embodiment of the present invention.
Figure 26B:
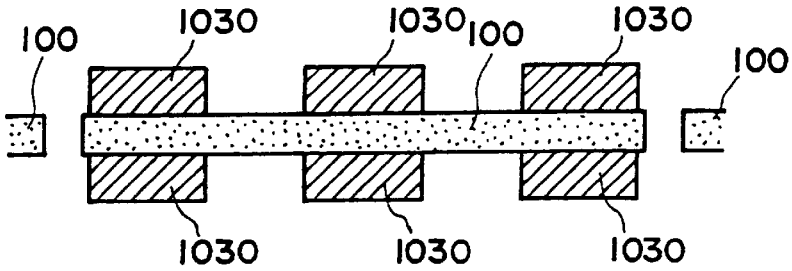
Figure 26C:
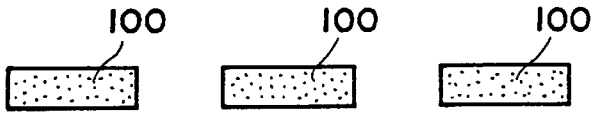
Figure 26D:
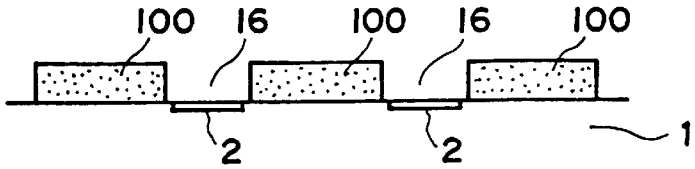

It is certified that error appears in the above-identified patent and that said Letters Patent is hereby corrected as shown below:

Column 32,
Line 1, "(c)," should read -- FIG. 25(c), --;
Line 6, "(d)," should read -- FIG. 25(d), --;
Line 23, "masspro-" should read -- mass pro- --;
Line 38, "(a)" should read -- FIG. 27(a) --;
Line 39, "(b)" should read -- FIG. 27(b) --;
Line 40, "FIG. 27, (a)," should read -- FIG. 27(a), --; and
Line 52, "FIG. 27, (b)," should read -- FIG. 27(b), --.

Column 33,
Line 65, "harmeticality" should read -- hermeticality --.

Column 34,
Line 3, "The" should read -- the --;
Line 58, "FIG. 30," should read -- FIG. 30 --;
Line 60, "(FIG. 30, (b))." should read -- (FIG. 30(b)). --;
Line 63, "(FIG. 30, (c))," should read -- (FIG. 30(c)), --; and
Line 64, "(FIG. 30, (d))." should read -- (FIG. 30(d)). --.

Column 35,
Line 2, "is" should read -- are --;
Line 3, "(FIG. 30, (e))." should read -- (FIG. 30(e)). --;
Line 5, "anther" should read -- another --;
Line 11, "(FIG. 30, (f))." should read -- (FIG. 30(f)). --;
Line 21, "FIG. 27, (a)." should read -- FIG. 27(a). --;
Line 43, "Similarly to" should read -- Similar to this --;
Line 46, "FIG. 30, (a)-(d)" should read -- FIGS. 30(a)-30(d) --;
Line 54, "(FIG. 32, (a))." should read -- (FIG. 32(a)). --; and
Line 57, "(FIG. 32, (c))," should read -- (FIG. 32(c)), --.

Column 36,
Line 6, "5 50," should read -- 550, -- and "5 60" should read -- 560 --;
Line 7, "5 70" should read -- 570 --;
Line 8, "5 90" should read -- 590 --;
Line 9, "FIG. 27, (a)." should read -- FIG. 27(a). --;
Line 31, "FIG. 30, (a)-(d)," should read -- FIGS. 30(a)-30(d), --;
Line 36, "(FIG. 34, (a))." should read -- (FIG. 34(a)). --;
Line 38, "(FIG. 34, (b))." should read -- (FIG. 34(b)). --;
Line 39, "is" should read -- are --; and
Line 65, "FIG. 34, (d)" should read -- FIG. 34(d) --.

UNITED STATES PATENT AND TRADEMARK OFFICE

CERTIFICATE OF CORRECTION

PATENT NO. : 6,206,508 B1
DATED : March 27, 2001
INVENTOR(S) : Yoshie Asakawa et al.

Figure 27A:
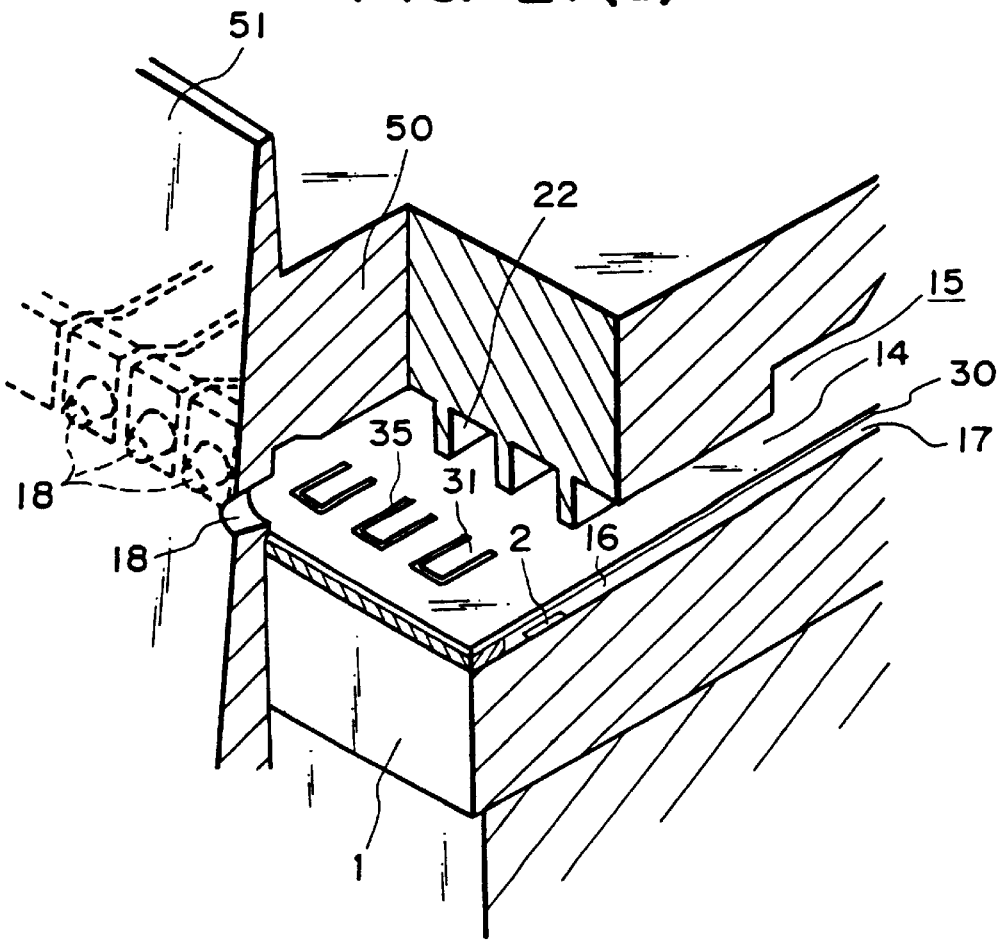
FIG. 27 illustrates a liquid ejecting head having a plurality of liquid flow paths according to an embodiment of the present invention, and (*a*) is a partly broken perspective view, and (*b*) is a sectional view of a separation wall.
Figure 27B:
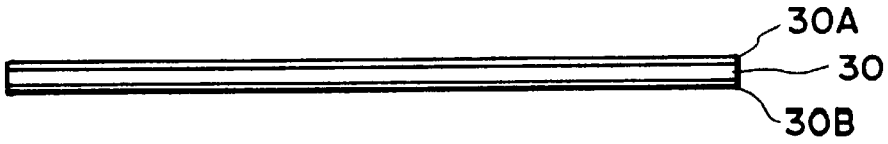

It is certified that error appears in the above-identified patent and that said Letters Patent is hereby corrected as shown below:

Column 37,
Line 3, "FIG. 27, (a)." should read -- FIG. 27(a). --;
Line 4, "degrees" should read -- degree --;
Line 35, "FIG. 32, (a) (b)" should read -- FIGS. 32(a), 32(b) --;
Line 36, "(d)" should read -- 32(d) --;
Line 37, "(c)" should read -- 32(c) --;
Line 43, "790 is" should read -- 790 are -- and "770 are" should read -- 770 is --; and
Line 48, "as" should read -- as a --.

Figure 34A:
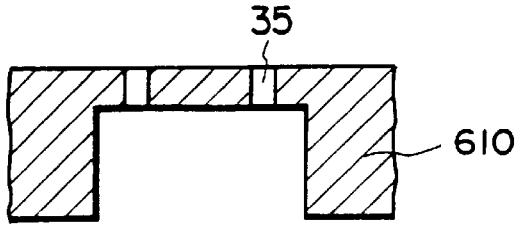
FIG. 34 is a schematic sectional view illustrating a further manufacturing step for the separation wall; In (*a*), an integral member for the bubble generation liquid flow path and the separation wall has been formed; In (*b*), polysulfone layer has been formed, and a laser beam has been applied; In (*c*), a movable member has been formed; And in (*d*), an ink jet recording head manufactured through the steps is shown as seen from the ejection outlet.
Figure 34B:
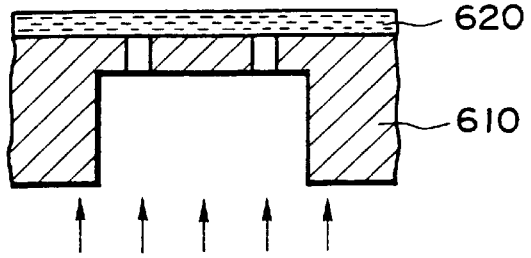
Figure 34C:
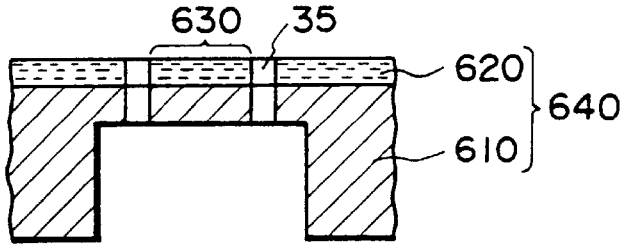
Figure 34D:
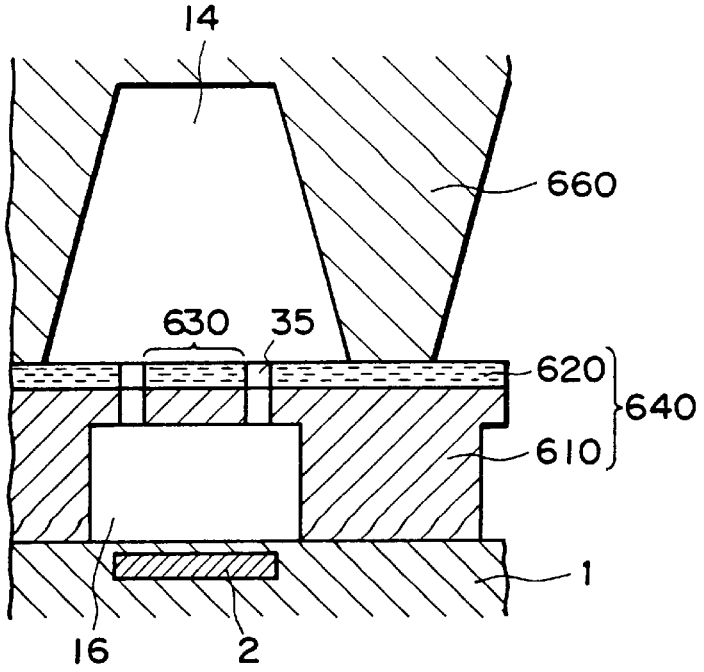

Column 38,
Line 9, "FIG. 34 (a)-(c)" should read -- FIGS. 34(a)-34(c) --;
Line 16, "8 90" should read -- 890 --;
Line 18, "formation" should read -- formed --; and
Line 48, "wall." should read -- walls. --.

Column 39,
Line 19, "18 1" should read -- 181 --;
Line 21, "18 2, 18 3" should read -- 182, 183 --;
Line 22, "18 5" should read -- 185 --; and
Line 58, "it" should read -- it is --.

Column 40,
Line 42, "15 17" should read -- 15 and 17 --.

Column 41,
Line 2, "grooved" should read -- grooved member 50 --;
Line 22, "supply and 221" should read -- and supply passage 221 --;
Line 28, "passage" should read -- passages --; and
Line 54, "an" should read -- a --.

Column 42,
Line 27, "on" should read -- on the --.

Column 43,
Line 41, "Said another" should read -- Another --; and
Line 47, "adjacent the" should read -- adjacent to the -- and "high-speed" should read -- a high --.

UNITED STATES PATENT AND TRADEMARK OFFICE

CERTIFICATE OF CORRECTION

PATENT NO. : 6,206,508 B1
DATED : March 27, 2001
INVENTOR(S) : Yoshie Asakawa et al.

It is certified that error appears in the above-identified patent and that said Letters Patent is hereby corrected as shown below:

Column 45,
Line 67, "means;" should read -- means, --.

Column 46,
Line 20, "liquid; and" should read -- liquid; --;
Line 22, "path;" should read -- path; and --; and
Line 34, "path, and" should read -- path, --.

Column 47,
Line 2, "is of metal such as nickel, gold" should read -- is made of metal such as nickel or gold --.

Signed and Sealed this

Seventh Day of May, 2002

*Attest:*

*Attesting Officer*

JAMES E. ROGAN
*Director of the United States Patent and Trademark Office*